US007850189B2

(12) United States Patent
Barber et al.

(10) Patent No.: US 7,850,189 B2
(45) Date of Patent: Dec. 14, 2010

(54) CURB CLIMBING WHEELCHAIR ATTACHMENT

(76) Inventors: Benjamin Barber, 15 Sherbrooke Rd., Hartsdale, NY (US) 10530; Richard Bordoni, 4 Rust Ave., Ardsley, NY (US) 10502; Julia Brady, 9 Crest Dr., White Plains, NY (US) 10607; Max Brivic, 15 Melissa Dr., Ardsley, NY (US) 10502; Michael Cornell, 2 Northway, Hartsdale, NY (US) 10530; James Doerhoff, 20 Old Mill La., Ardsley, NY (US) 10502; Jonathan Goldszmidt, 21 Chestnut Ridge Way, Dobbs Ferry, NY (US) 10522; Jeffrey Rovenpor, 85 Ridge Rd., Ardsley, NY (US) 10502; Sahib Singh, 37 Lincoln Ave., Ardsley, NY (US) 10502; David B. Ponterio, 48 Valimar Blvd., White Plains, NY (US) 10603; Ahron Rosenfeld, 3235 Cambridge Ave. Apt 7H, Bronx, NY (US) 10463

( * ) Notice: Subject to any disclaimer, the term of this patent is extended or adjusted under 35 U.S.C. 154(b) by 245 days.

(21) Appl. No.: 12/252,942

(22) Filed: Oct. 16, 2008

(65) Prior Publication Data

US 2009/0108561 A1 Apr. 30, 2009

Related U.S. Application Data

(60) Provisional application No. 60/983,386, filed on Oct. 29, 2007.

(51) Int. Cl.
*A61G 5/10* (2006.01)
*B63B 27/14* (2006.01)

(52) U.S. Cl. ..... 280/304.1; 14/71.1

(58) Field of Classification Search ..... 280/304.1, 280/250.1, 1.181, 218, 219; 14/69.5, 71.1; 180/8.1, 8.2, 8.3, 8.4, 8.5, 8.6; 901/1, 14, 901/15

See application file for complete search history.

(56) References Cited

U.S. PATENT DOCUMENTS

| | | | | |
|---|---|---|---|---|
| 4,132,423 | A * | 1/1979 | Chant | 280/5.3 |
| 4,912,796 | A * | 4/1990 | Crump | 14/69.5 |
| 5,037,120 | A * | 8/1991 | Parisi | 280/250.1 |
| 6,175,982 | B1 | 1/2001 | Cushwa | |
| 6,463,613 | B1 | 10/2002 | Thompson | |
| 7,597,163 | B2 | 10/2009 | Goertzen et al. | |
| 2007/0194554 | A1 * | 8/2007 | Slagerman | 280/304.1 |

* cited by examiner

*Primary Examiner*—Lesley Morris
*Assistant Examiner*—Jacob Knutson
(74) *Attorney, Agent, or Firm*—Cowan, Liebowitz & Latman, P.C.; Mark Montague, Esq.

(57) ABSTRACT

A curb climbing wheelchair system having left and right side attachments are designed to be attached to left and right side portions, respectively, of a standard wheelchair to enable a wheelchair occupant to climb a curb, bump or other obstruction without the aid of another individual. Each attachment includes a ramp extending from a telescoping arm that is designed to be attached, via a clamping system, to one side of the wheelchair. When not in use, the ramps are folded and stowed away on the sides of the wheelchair. During use, the ends of the ramps are placed on the curb to allow the wheelchair occupant to roll up the curb. To retrieve the ramps (now disposed behind the wheelchair), the wheelchair occupant moves the telescoping arms, if necessary with the aid of an attached circular handle, to lift the ramps thus allowing the wheelchair occupant to grab the ramps. The retrieved ramps then are stowed away until needed.

14 Claims, 32 Drawing Sheets

(bottom view)

(bottom view)

CURB CLIMBING WHEELCHAIR ATTACHMENT

REFERENCE TO RELATED APPLICATION

This application claims priority to U.S. Provisional Patent Application No. 60/983,386, filed Oct. 29, 2007, the disclosure of which is incorporated herein by reference.

FIELD OF THE INVENTION

Our invention is directed to a wheelchair attachment for enabling a wheelchair to climb a curb, which we call the Curb Conqueror Wheelchair Attachment. The invention is attached to a standard wheelchair and allows the occupant to manually climb over a curb, from street level to sidewalk level. This function that is so routine in our lives has previously disrupted the lives of wheelchair occupants, leading to great inconveniences and frustrations. By removing these negative effects, our attachment enables those who must surmount curbs without cutouts to do so. Consequently, our project is extremely useful, like anything that improves lives.

BACKGROUND OF THE INVENTION

Throughout the world, many communities have overlooked seemingly trivial improvements which are, in actuality, crucial to many. Many disabled individuals are not given what they need to lead a life that is similar to those around them. One of the biggest obstacles that these people face daily is going up a curb.

In the lives of the disabled, a problem such as going up a curb can snowball into much larger tribulations. If people cannot ascend and descend curbs, they cannot continue with their daily lives—routines are interrupted and great inconvenience is caused. Without going through the day-to-day actions necessary in life, a person will not be pleased with his or her position. Many lawsuits have occurred over problems such as this one. People in wheelchairs do not feel as if they are being treated as equals, and will not stand for any type of inequality. In certain communities, curb cutouts do not exist. In other communities, curb cutouts are neglected by being piled with snow in the winter, and strewn with garbage in the summer.

A curb, to a regular wheelchair traveler, is a concrete wall impossible to scale without the help of a curb cutout. In countless neighborhoods, curbs are just that: insurmountable.

Although existing gyroscope-based wheelchairs climb curbs and stairs, they are too complex and expensive. The iBOT, for example, has a base price of $26,100 (Independence Technology). Some portable ramps can be positioned onto curbs, but these require an assistant, making the wheelchair occupant dependent on others. U.S. Pat. No. 6,463,613 describes a portable ramp that can be situated over stairs and curbs. It is comprised of slats held together by straps, enabling each plank to unfold. This forms a ramp storable when its ends retract inward. Due to their design, the rotational slats can accept excessive weight, while two lightweight braces contribute to the resistance of the ramp's center. Needless to say, the ramp is not attached to a wheelchair.

Although there are various wheelchairs and ramp systems on the current market today, the consumers of these products continue to remain dependent on others; whether it requires one to place the ramp in front of an area of incline, to push someone up a curb, or to provide any further assistance, the independence of disabled individuals remains limited. It is not the question of reinventing the ramp, but enhancing the lives of disabled individuals so that their lifestyles do not limit their opportunities.

U.S. Pat. No. 6,175,982 proposes a ramp separate from the wheelchair. Although the appeal of this ramp is its price and easy storage compared to conventional ramps, it runs on a complex gear system. The wheelchair clicks in to roller guides, and, through an elaborate process, eventually goes up. In this scenario, a wheelchair occupant can use the ramp independently, or with the help of another person. Although the ramp is not attached to the wheelchair, the gear system compensates for height variations in different locations. This design's principal flaw is that it is not portable, but locked into a surface. Although the appeal of this ramp is its price value in contrast to conventional ramps as well as its compactness, it has a complex gear system. The geared system comprises drive gears and roller guides on the wheelchair that line up along guide tracks; ratchet devices along with the rotation of the drive wheels are used to begin the alignment of the gears on the guide tracks. For this scenario, a wheelchair occupant is still dependent on a second person, who manually moves the track and the wheelchair upwards. Although the ramp is not fixed to the wheelchair, the gear system compensates for variances in heights of different surfaces. Ultimately, an assistant pushes the wheelchair up the ramp until the occupant can use the wheelchair independently on a level plane.

There are no studies that indicate the number of communities violating the American Disabilities Act by disregarding curb cutouts. There are, however, numerous lawsuits around the country that result from different factors. For example, some municipalities cannot afford to redo all sidewalks. In The Journal News, the village manager of Mamaroneck, N.Y., states that the cost of replacing a fifty-foot sidewalk is roughly $1,500. He indicates that even though there is money to fund the curb cutouts, they are in competition with many other government-mandated projects.

According to the reports of the U.S. Department of Transportation, Federal Highway Administration (Lesson 17), and results gathered by The Veterans Administration, a handicapped individual is forced to put forth thirty percent more effort when traveling a given distance on a path than a normal individual who walks the same distance. If, we can reduce that strain by eliminating the curb as a towering obstacle, then we can improve the daily lives of fellow humans.

Ever since the modern wheelchair was invented in 1932 by Harry Jennings, people have been trying to perfect it. Some inventions, including those mentioned above, are geared to solving the dilemma of getting a wheelchair up a curb. But none solve this dilemma in a manner that is economic and usable by the wheelchair operator without assistance from another person.

OBJECTS AND SUMMARY OF THE INVENTION

In view of the foregoing, we have designed a simple, economic, manually powered, and self operated attachment to existing wheelchairs. With such design, it is our object to provide a device designed to assist and improve the lives of disabled individuals.

Our curb climbing wheelchair attachment, which includes dual ramps, solves the curb cutout problem by attaching to a wheelchair's armrest, from which the occupant lowers the dual ramps to the road and curb. Once the ramps make contact with the road and the sidewalk, they are wedged in place. The wheelchair occupant can then roll the wheelchair over the ramps without concern for the ramps' stability.

The ramps involve a telescoping ramp system that can be attached to both sides of a standard wheelchair. The ramp system is light-weight, simple to operate, cost-effective, and requires no power. Our invention would most likely cost just a fraction of the cost of comparable existing devices.

To summarize, in accordance with our invention, the curb climbing wheelchair attachment includes left and right side attachments that are designed to be attached to left and right side portions, respectively, of a wheelchair. Each of the left and right side attachments comprises a telescoping arm that is adapted (i.e., designed) to extend between an extended length and a shortened length, a ramp that is rotatably coupled to a first end of the telescoping arm, a handle fixed to the telescoping arm and adapted to be grabbed by an occupant of the wheelchair to control an orientation of the telescoping arm, a ramp holder coupled to the telescoping arm and adapted to maintain the ramp in a stowed position when not in use, and a clamping mechanism rotatably coupled to the telescoping arm for enabling attachment of the respective side attachment to the respective side portion of the wheelchair. The ramps of the left and right side attachments are collectively designed, when in a deployed position, to allow the occupant of the wheelchair to move the wheelchair up the ramps.

As an aspect of the invention, the ramp (i.e., each ramp of the left and right side attachments) is adapted to be movable from the stowed position to a deployed position abutting against a curb, wherein in the deployed position a front end of the ramp is positioned on the curb and a rear end of the ramp is positioned on a surface disposed adjacent to and beneath the curb. The telescoping arm is extended to substantially the extended length when the ramp is in the deployed position, and the telescoping arm is adapted to have a length that decreases in length, approaching substantially the shortened length, as the wheelchair is rolled onto the ramp.

As another aspect of the invention, the telescoping arm (i.e., of each attachment) is adapted to increase in length, approaching substantially the extended length, as the wheelchair is rolled from a position on the ramp to a position substantially beyond the ramp.

As a further aspect of the invention, when the wheelchair is positioned beyond the ramp, the orientation of the telescoping arm is adapted to be modified by the occupant of the wheelchair to cause the first end of the telescoping arm to be raised to enable the occupant to grab the ramp and to place the ramp in the stowed position within the ramp holder.

As an additional aspect of the invention, the ramp includes first and second ramp segments that are hinged together. The ramp is movable between a folded position and an extended position.

As a feature of this aspect, the ramp further includes a latch that is designed to selectively lock the first and second ramp segments in the folded position, and to selectively lock the first and second ramp segments in the extended position.

As another aspect of the invention, the ramp includes at least one pin that extends substantially downward when the respective ramp is in the deployed position so that the pin abuts a curb and supports the position of the ramp relative to the curb during use.

As yet another aspect of the invention, the ramp includes an angled lip so that, when the ramp is in the deployed position, the angled lip lays substantially flat on the curb and a lower end of the ramp rests on the surface disposed beneath the curb (e.g., the street).

As a further aspect of the invention, the handle (i.e., of each attachment) is a circular handle rotatable about a pivot point. The circular handle is fixed to the telescoping arm, and the pivot point is disposed at a position along the telescoping arm at which the clamping mechanism is rotatably coupled to the telescoping arm so that rotation of the handle causes a change in orientation of the telescoping arm.

As an additional aspect of the invention, each of the left and right side attachments further includes a counter-balance coupled to the second end of the respective telescoping arm.

As still yet a further aspect of the invention, the ramp holder is an inverted T-shaped device adapted to maintain the respective ramp in the stowed position when not in use.

As still yet an additional aspect of the invention, the clamping mechanism is a clamp adapted to be attached to tubing of the wheelchair.

As will be evident from the following detail description, and as summarized above, our idea is completely different than those before it. Instead of making an expensive mechanized piece of equipment, we decided that we would not use any electronic parts whatsoever in the preferred embodiment of our invention. This helps to drastically reduce cost, and to make the invention more reliable (no parts can ever run out of battery if no battery is being used). We also invented a ramp that is connected to the wheelchair, rather than one that must be manually moved from curb to curb. By having these and other features, we achieved something that no one has ever done before.

BRIEF DESCRIPTION OF THE DRAWINGS

The following detailed description, given by way of example and not intended to limit the present invention solely thereto, will best be appreciated in conjunction with the accompanying drawings, wherein like reference numerals denote like elements and parts, in which.

DETAILED DESCRIPTION OF THE PRESENT INVENTION

We have designed a product that enables the wheelchair user to ascend a curb without the need for another person to tilt the wheelchair in order to ascend the curb and without the need for a ramp to be separately carried around. As described in detail below, the ramps are attached to the wheelchair so that they do not need to be carried. A telescoping mechanism, similar to a drawer slide, extends the ramps in relation to the wheelchair. A clamping system enables the invention to be easily attached to the side of any standard wheelchair so that the invention may be used without the need to purchase expensive, specially-designed, non-standard wheelchairs. Circular handles, placed reasonably near the wheelchair operator's arms, are turned to help deploy the dual ramps and to retract the ramps after use. The ramps fold and are stowed away on the sides of the wheelchair in a manner that minimally obstructs the wheelchair operator during normal use. As mentioned above, our ultimate goal is to provide a wheelchair attachment that is economic, easily installed to standard wheelchairs, and most importantly allows the wheelchair operator to roll up a curb without assistance.

Figure 1:
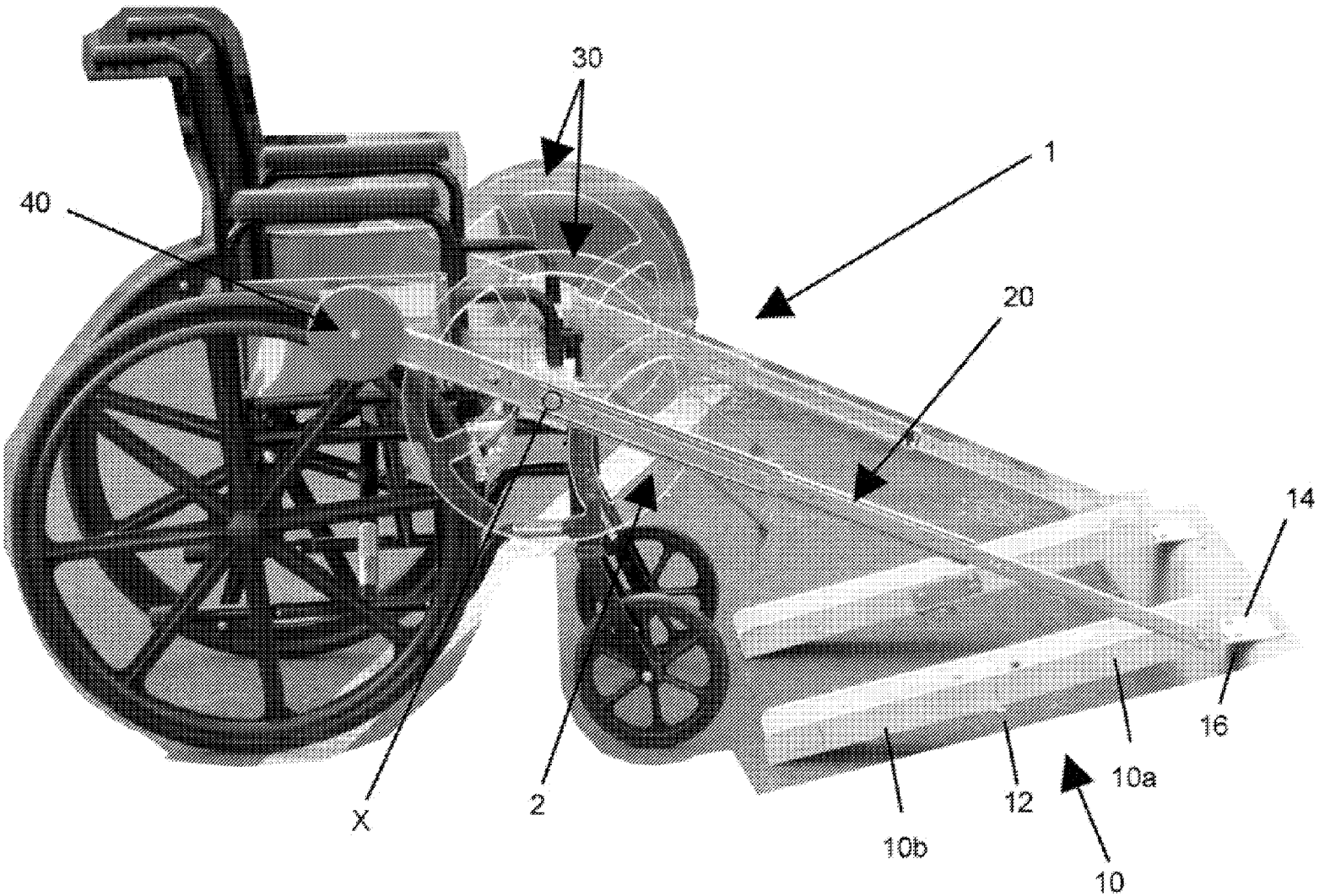
FIG. 1 shows our curb climbing wheelchair attachment of the present invention installed on a standard wheelchair.

Referring now to the accompanying figures, FIG. 1 shows the curb climbing wheelchair attachment of the present invention installed on a standard wheelchair. In particular, FIG. 1 shows the curb climbing wheelchair attachment already in a deployed position. Other figures discussed below show the attachment in various other positions during its use. As shown in FIG. 1, the curb climbing wheelchair attachment is comprised of a left side attachment 1 and a right side attachment 2. Left and right side attachments 1 and 2 are symmetrical components and are designed to be attached to the left and right sides, respectively, of a standard wheelchair.

In this detailed description, a description of the various elements of the curb climbing wheelchair attachment is first provided, followed by a discussion of how the curb climbing wheelchair attachment is utilized.

Figure 2A:
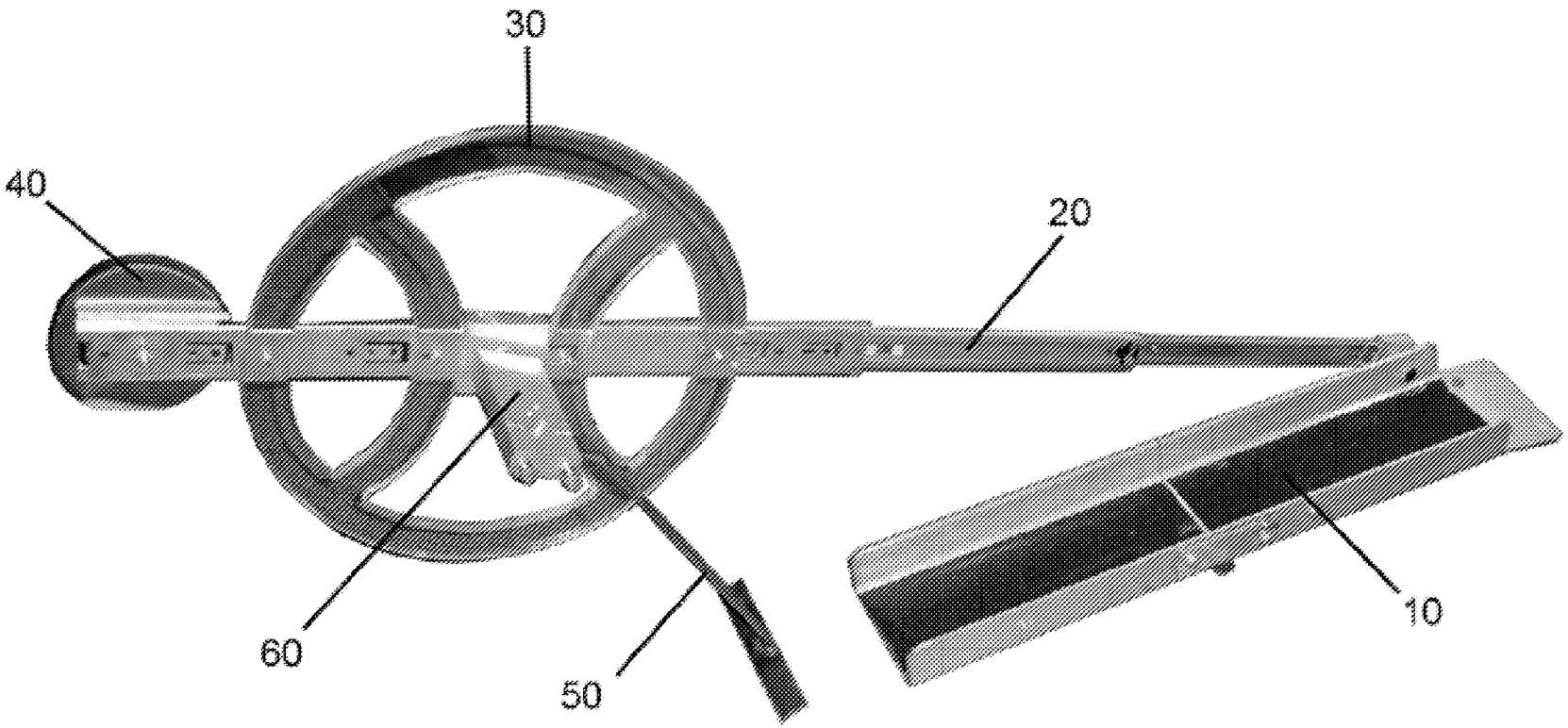
FIG. 2A shows one side of the curb climbing wheelchair attachment (shown not connected to a wheelchair) and FIG. 2B is a schematic illustration of the curb climbing wheelchair attachment.
Figure 2B:
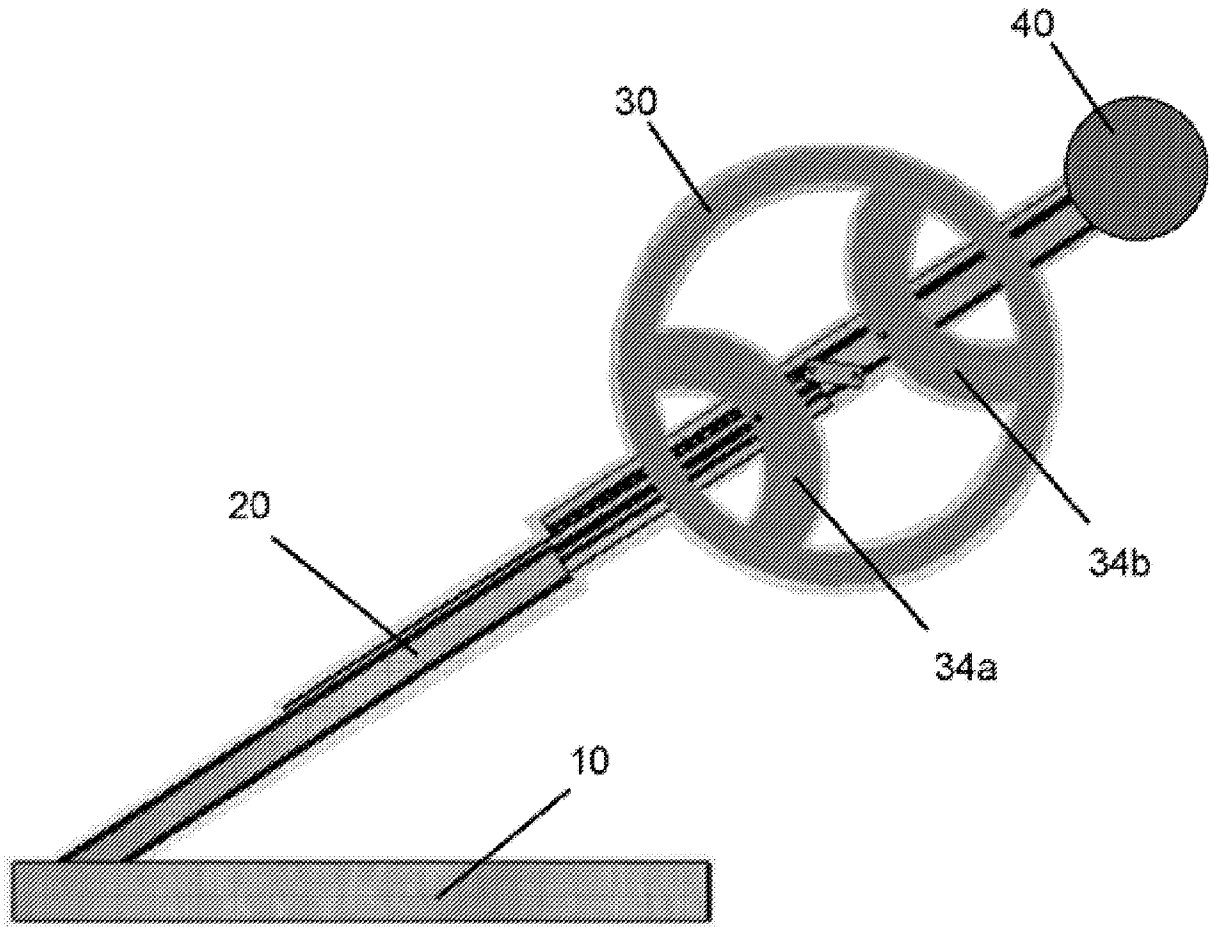

FIG. 2A shows one side of the curb climbing wheelchair attachment (shown not connected to a wheelchair), and FIG. 2B is a schematic illustration of the curb climbing wheelchair attachment. For convenience, all discussion hereinafter concerning the curb climbing wheelchair attachment of the present invention refers to both the left and right side attachments. As shown in FIGS. 2A and 2B, the curb climbing wheelchair attachment includes, as its principal components, a ramp 10, a telescoping arm 20 and a circular handle 30. The curb climbing wheelchair attachment further includes a counter-balance 40, an inverted T-shaped holder 50, and a clamping system 60 (inverted T-shaped holder 50 and clamping system 60 not shown in FIG. 2B). Each of these elements, as well as their manner of interconnection with one another, is further discussed below.

The Dual Ramps

Ramp 10 of each of the left and right side attachments of the curb climbing wheelchair attachment (sometimes collectively referred to herein as the "dual ramps"), when in the deployed position such as shown in FIG. 1, enables the wheelchair operator to climb over a curb. Ramp 10 preferably is around 24 inches long to accommodate a standard-height curb, but may be longer or slightly shorter. Ramp 10 preferably is 5 inches wide to accommodate the wheels of a standard wheelchair. Ramp 10 may be made of channel aluminum or other suitably strong material.

Figure 3A:
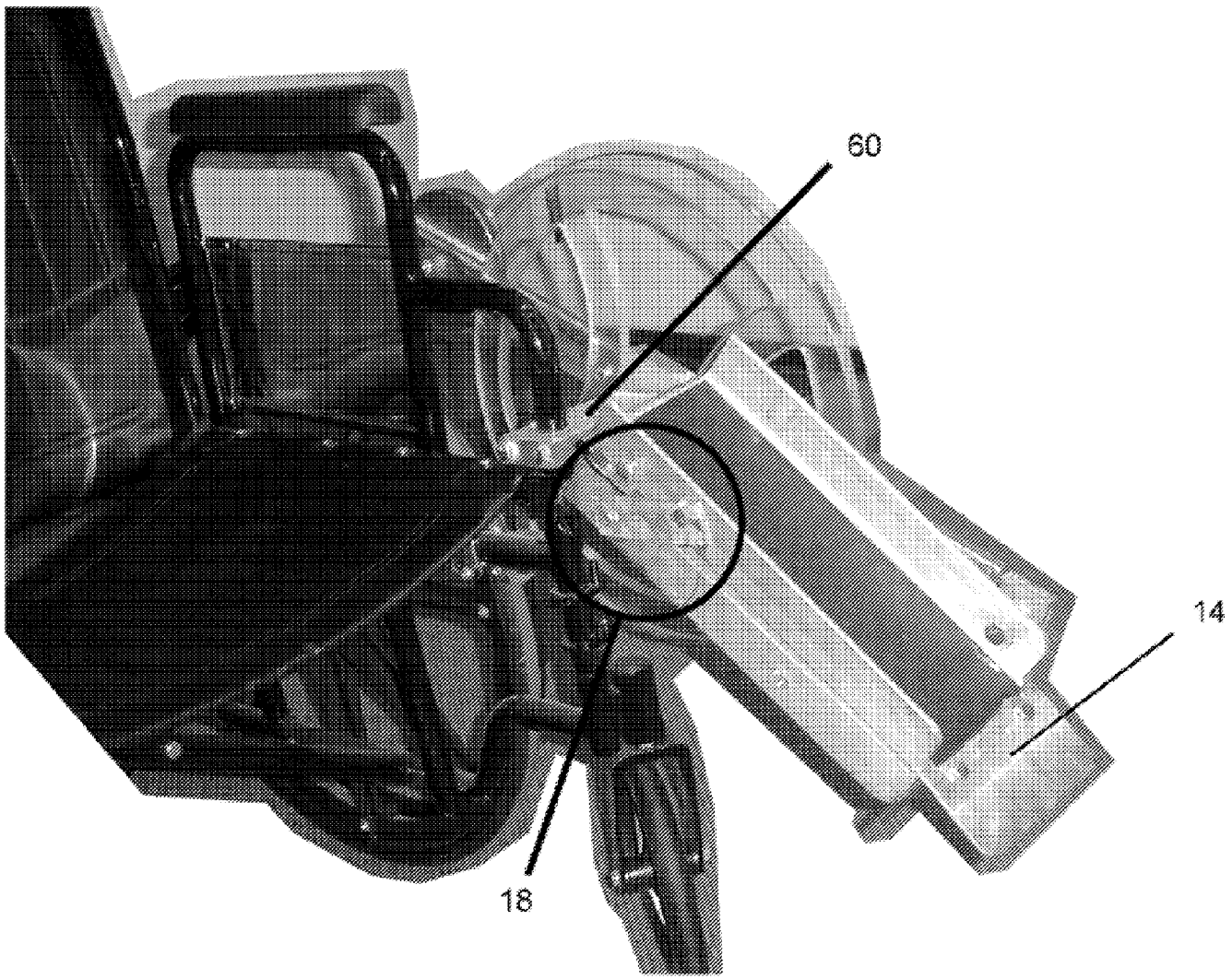
FIGS. 3A-3G show additional views of the curb climbing wheelchair attachment with particular emphasis on the ramp.

Ramp 10 is particularly shown in and discussed with reference to FIGS. 3A-3G, as well as FIGS. 1 and 4A-4B. Ramp 10 is comprised of two adjacent 12-inch long segments 10*a* and 10*b* (see, e.g., FIG. 3C). Ramp segments 10*a* and 10*b* are connected together via a sufficiently strong hinge 12 (FIGS. 3C-3E and 3G). The two segments can be folded against one another, as shown in FIG. 3A. As further discussed below, the ramp is folded when not in use. When in use, ramp segments 10*a* and 10*b* form a single, extended flat ramp, such as shown in FIGS. 1, 3F, 3G and 4A.

Figure 3B:
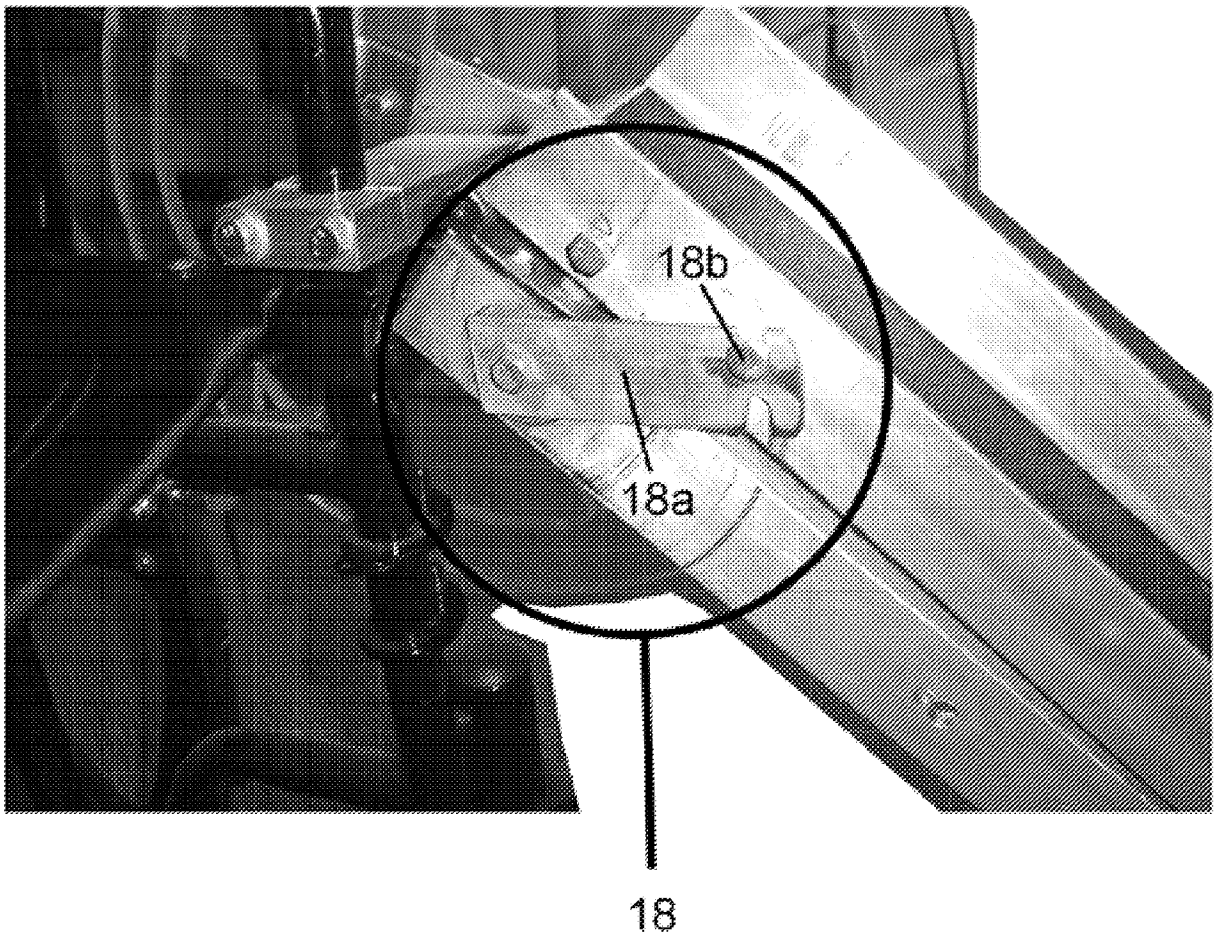
Figure 3C:
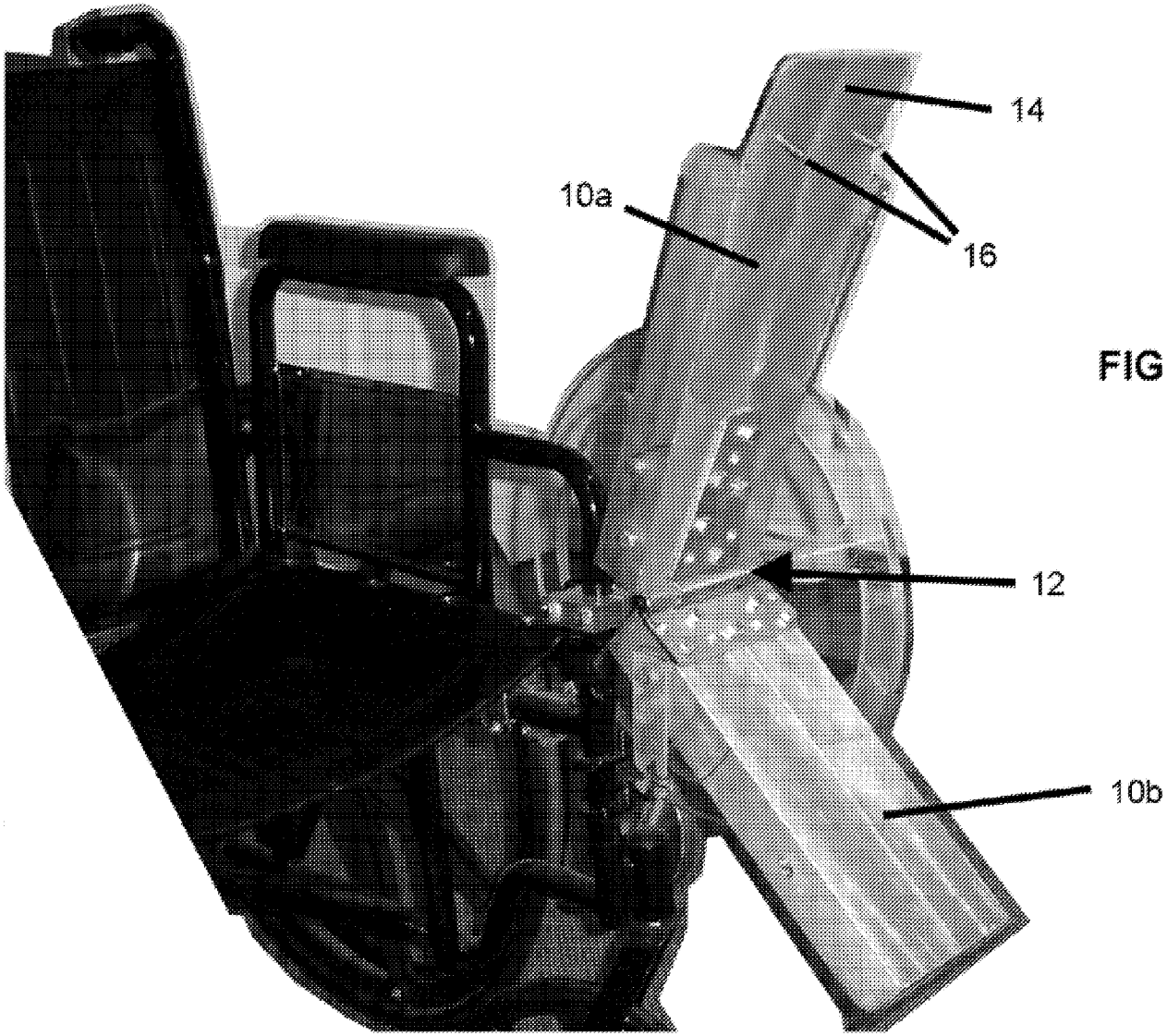
Figure 3E:
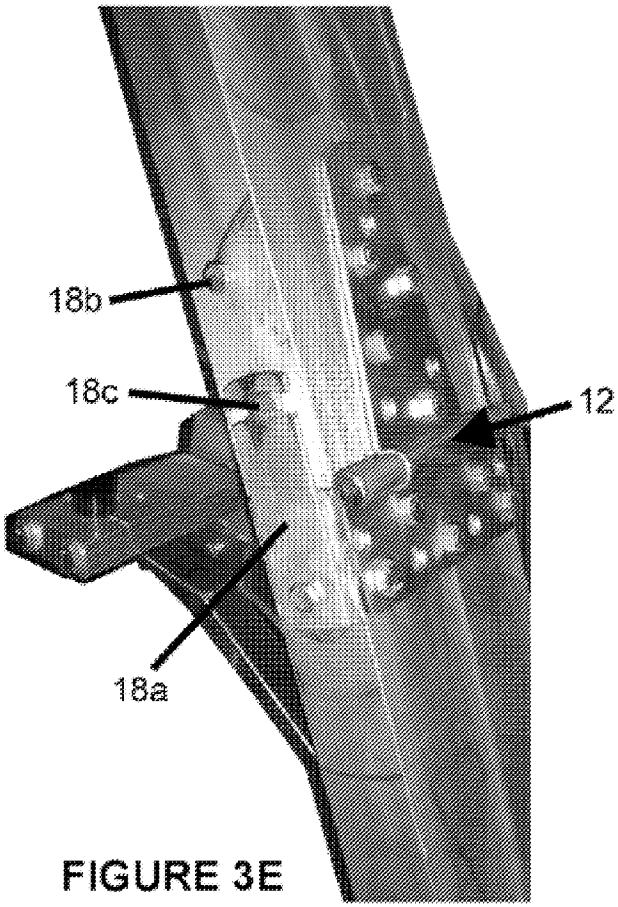
Figure 3D:
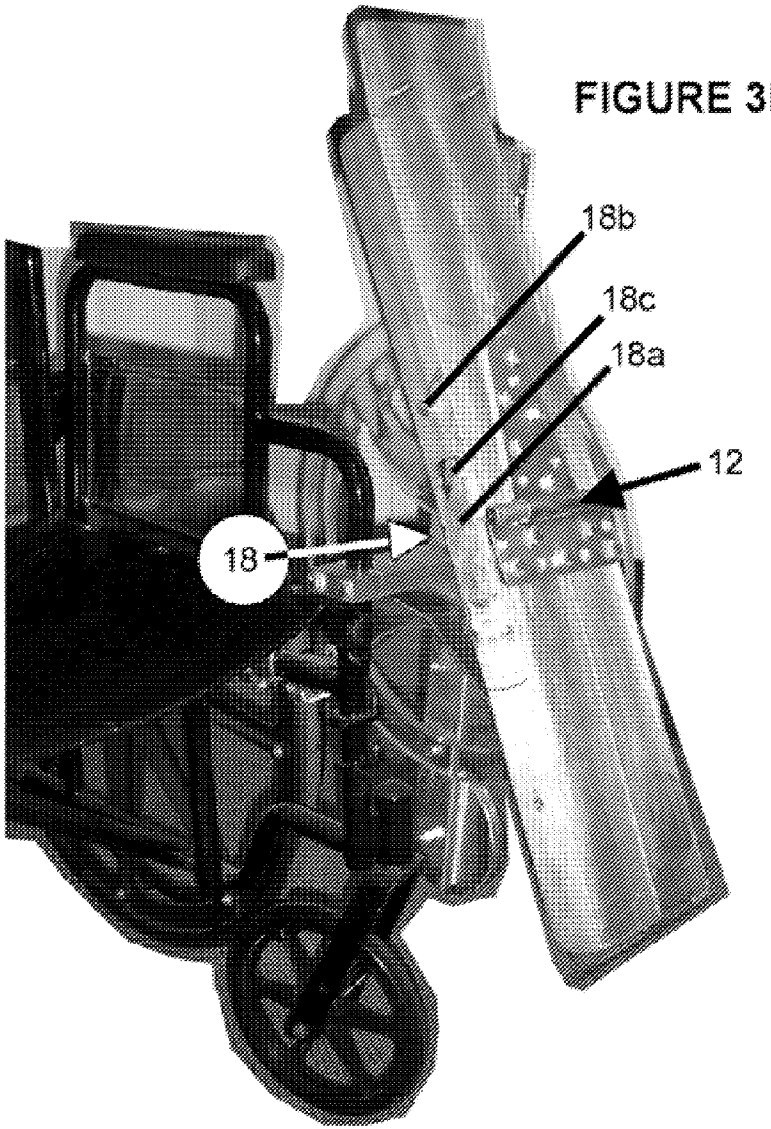
Figure 4A:
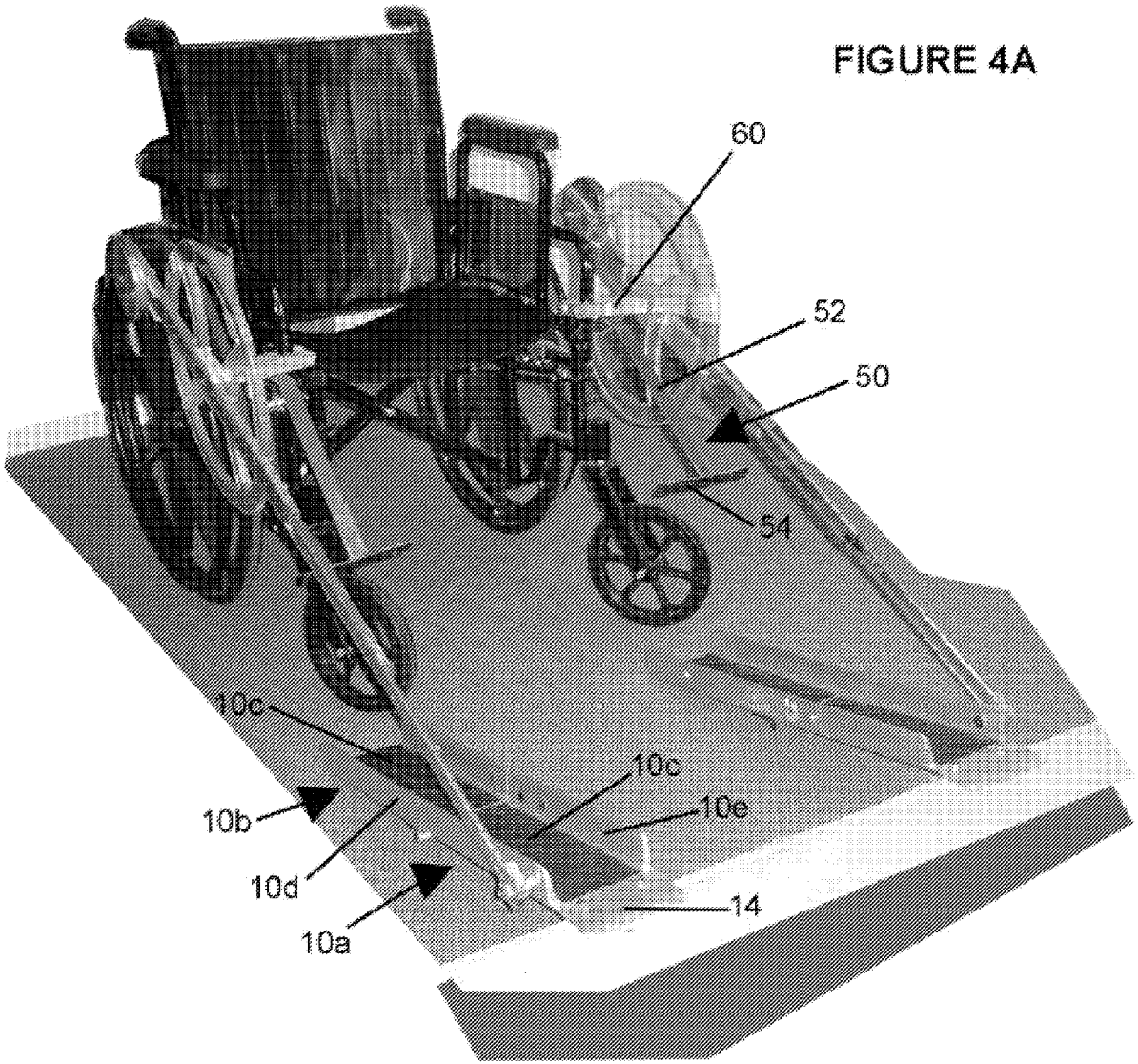
FIGS. 4A and 4B show the curb climbing wheelchair attachment, installed on a wheelchair, with the ramps in the deployed position.
Figure 4B:
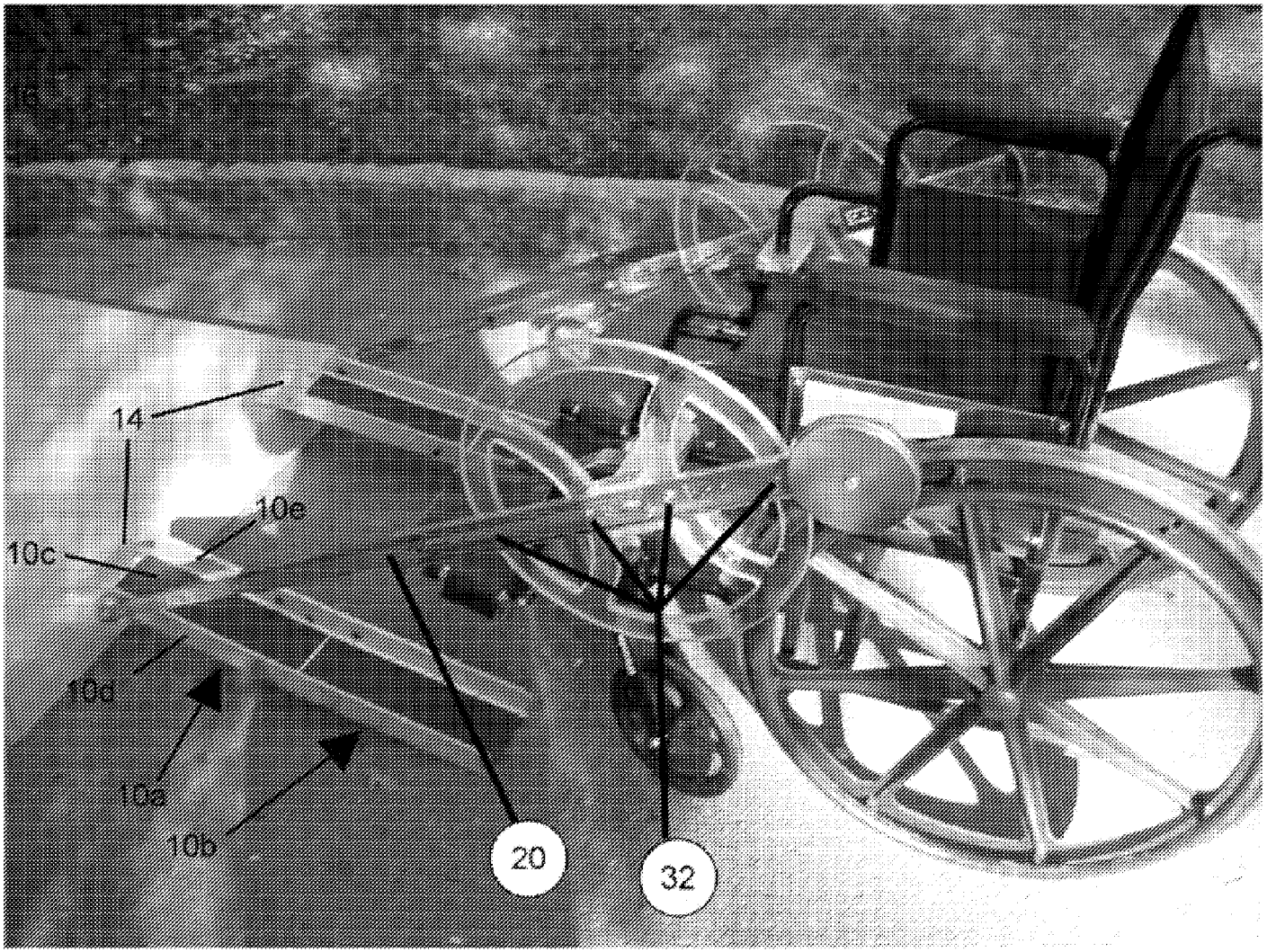

Ramp 10 includes a latch 18, as shown in FIGS. 3A and 3B, for manually locking the ramp in its folded position. The latch shown employs a rotatable hooking member 18*a* and a first locking bolt 18*b* into which hooking member 18*a* latches. However, other suitable latches may be employed. In addition, latch 18 further is able to lock ramp 10 in its extended position via use of a second locking bolt 18*c* as shown in FIGS. 3D and 3E.

Each ramp segment 10*a* and 10*b* includes a wheelchair support surface 10*c* (see FIGS. 4A & 4B) over which the wheels of the wheelchair roll. Preferably, support surface 10*c* has a non-slip surface. Each ramp segment also includes left and right side walls 10*d* and 10*e* (FIGS. 4A & 4B) that operate as guides to prevent the wheelchair from falling off support surface 10*c* during the ramp's use.

Ramp 10 also includes a lip 14 (see FIGS. 1, 3A, 3G, 4A and 4B) that extends from one end of ramp segment 10*a*. Lip 14 is supported by the curb during use. Preferably, lip 14 extends from ramp segment 10*a* at a small angle (see FIGS. 1, 3A and 3G) so that lip 14 lays reasonably flat on the curb (i.e., hugs the curb). Lip 14 should be suitably long (e.g., 3 inches long).

Figure 3F:
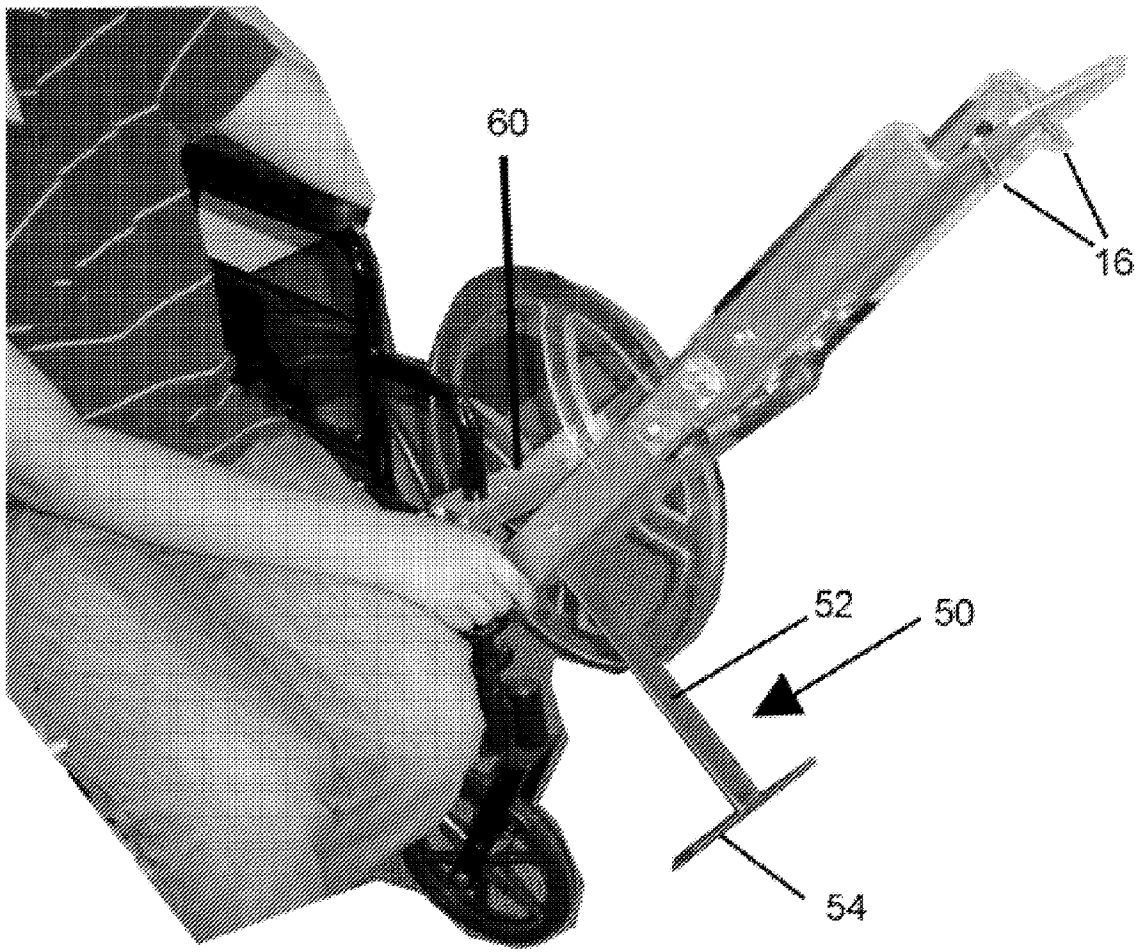
Figure 3G:
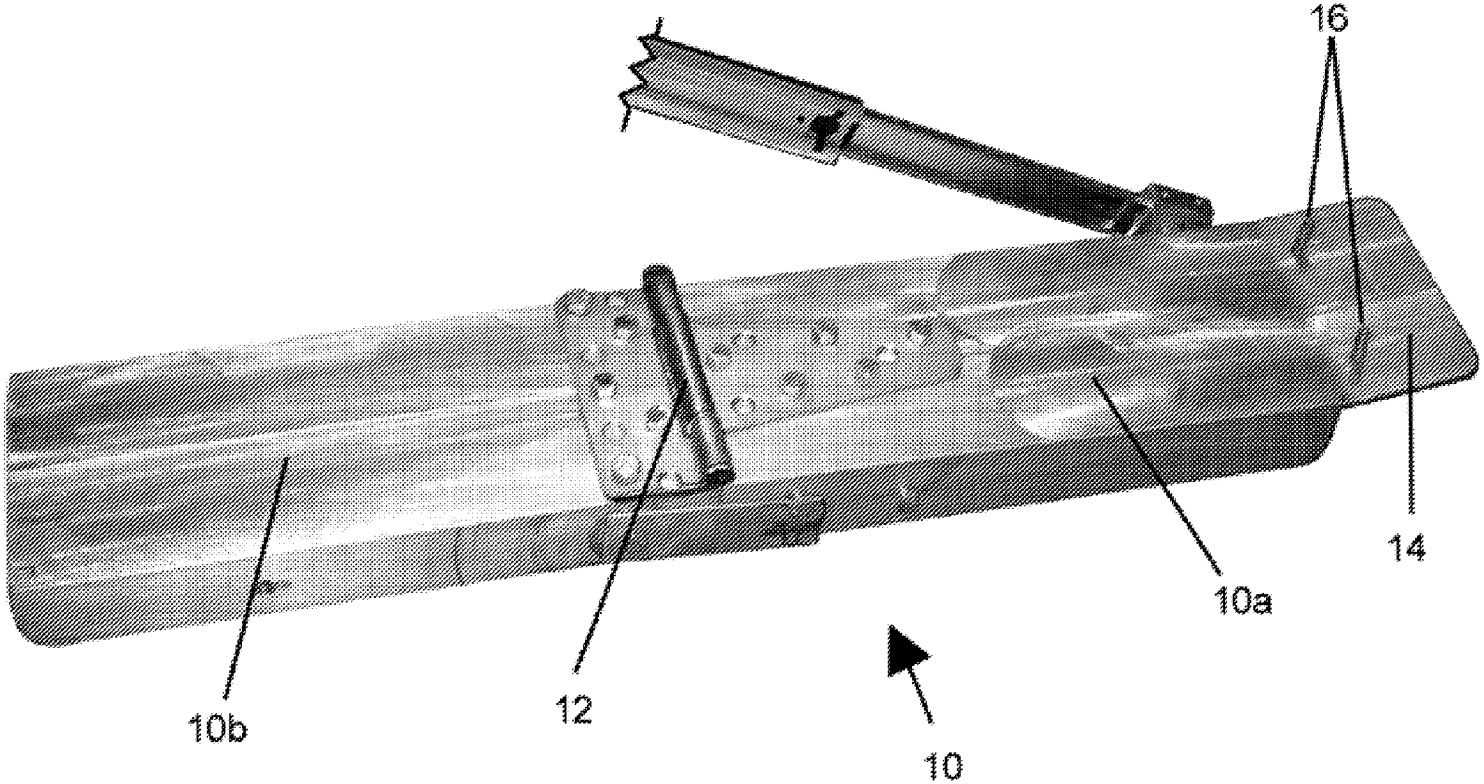

A pair of pins 16 preferably extend from the underside of lip 14, as shown in FIGS. 3F and 3G, and which operate as a "stop" to assist in the wheelchair in the proper deployment of the ramp. As shown in FIG. 1, when the ramp is properly deployed, pins 16 abut against the curb. That is, the wheelchair operator places the lip 14 of the ramp on the curb, during ramp deployment, and attempts to place the ramp so that pins 16 extending beneath lip 14 abut against the side of the curb. At this point, a sufficient length of lip 14 is on the curb to ensure that the ramp does not fall to the street while the wheelchair rolls up it.

The Telescoping Arm

Figure 5:
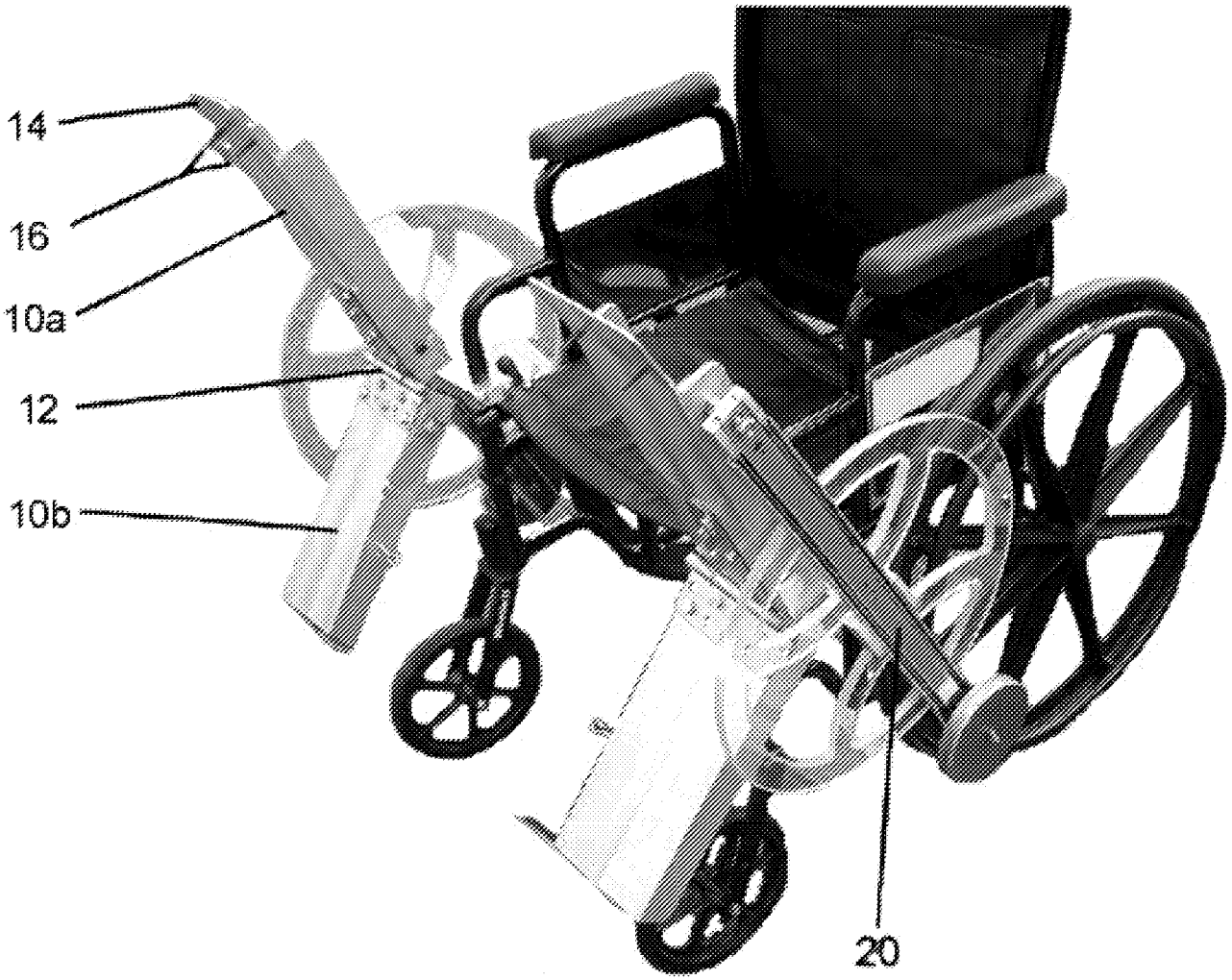
FIG. 5 shows the ramps in the partially deployed position.
Figure 13A:
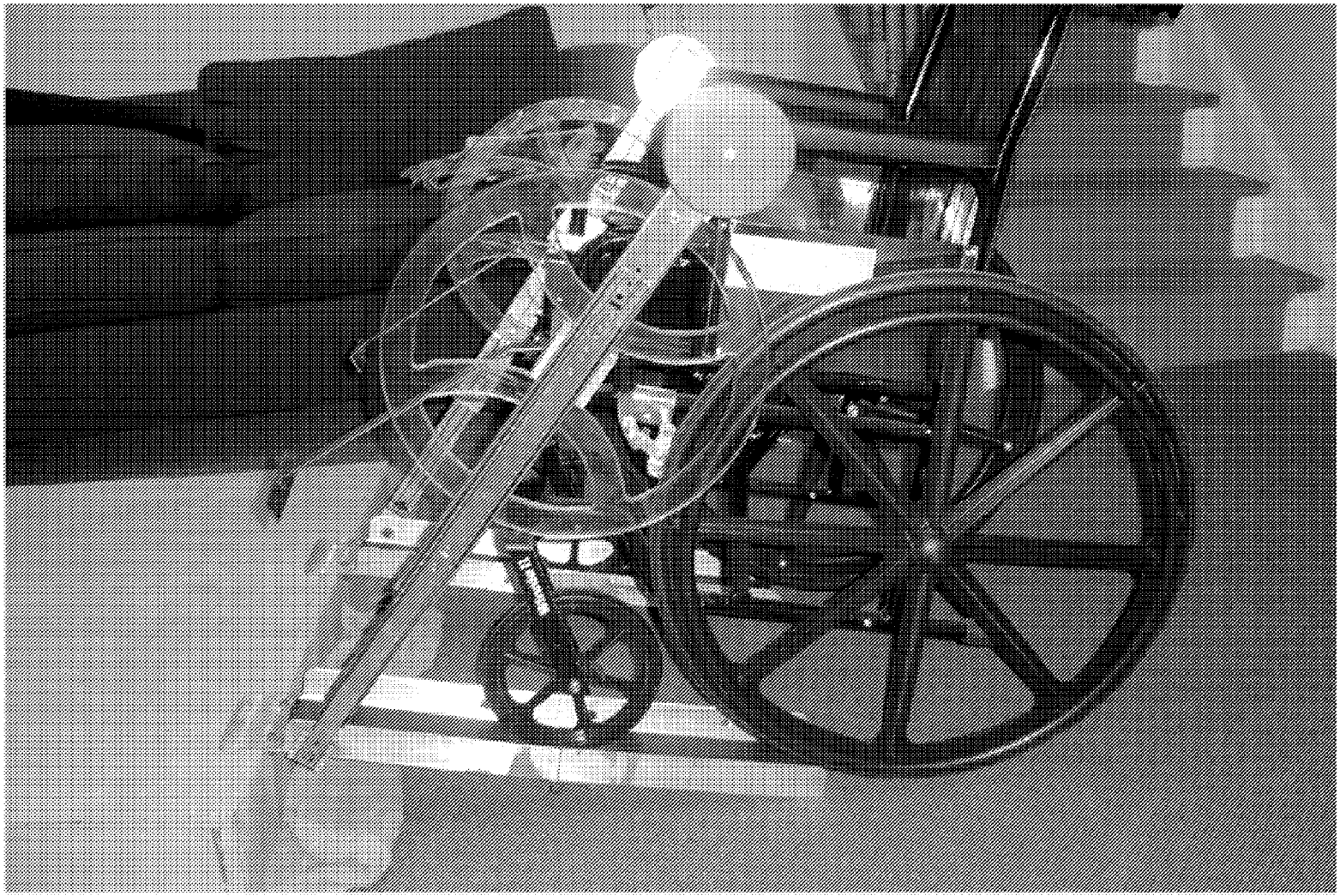
FIGS. 13A-13D show various views during different points of operation of the present invention as the wheelchair rolls up the ramps.
Figure 13B:
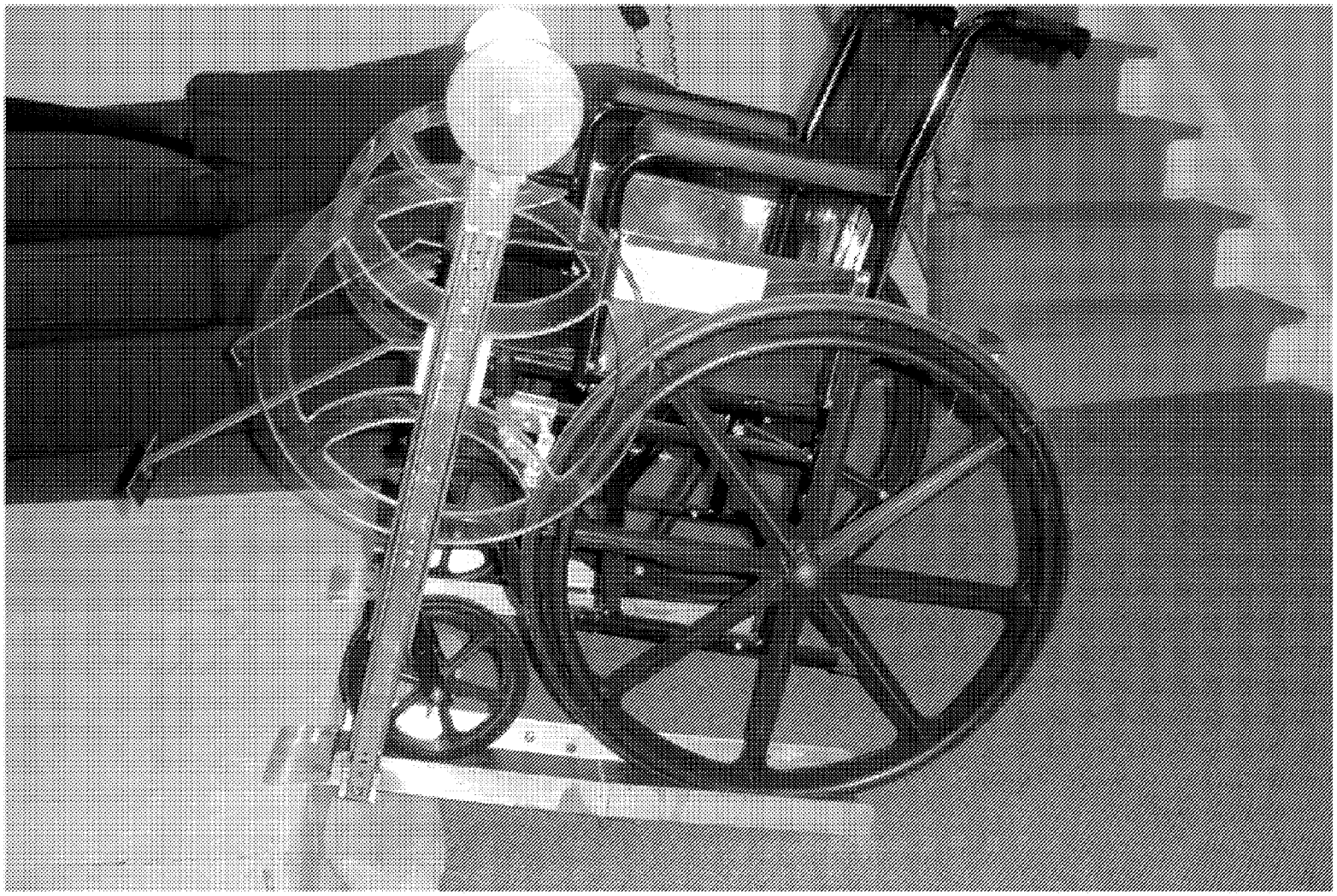
Figure 13C:
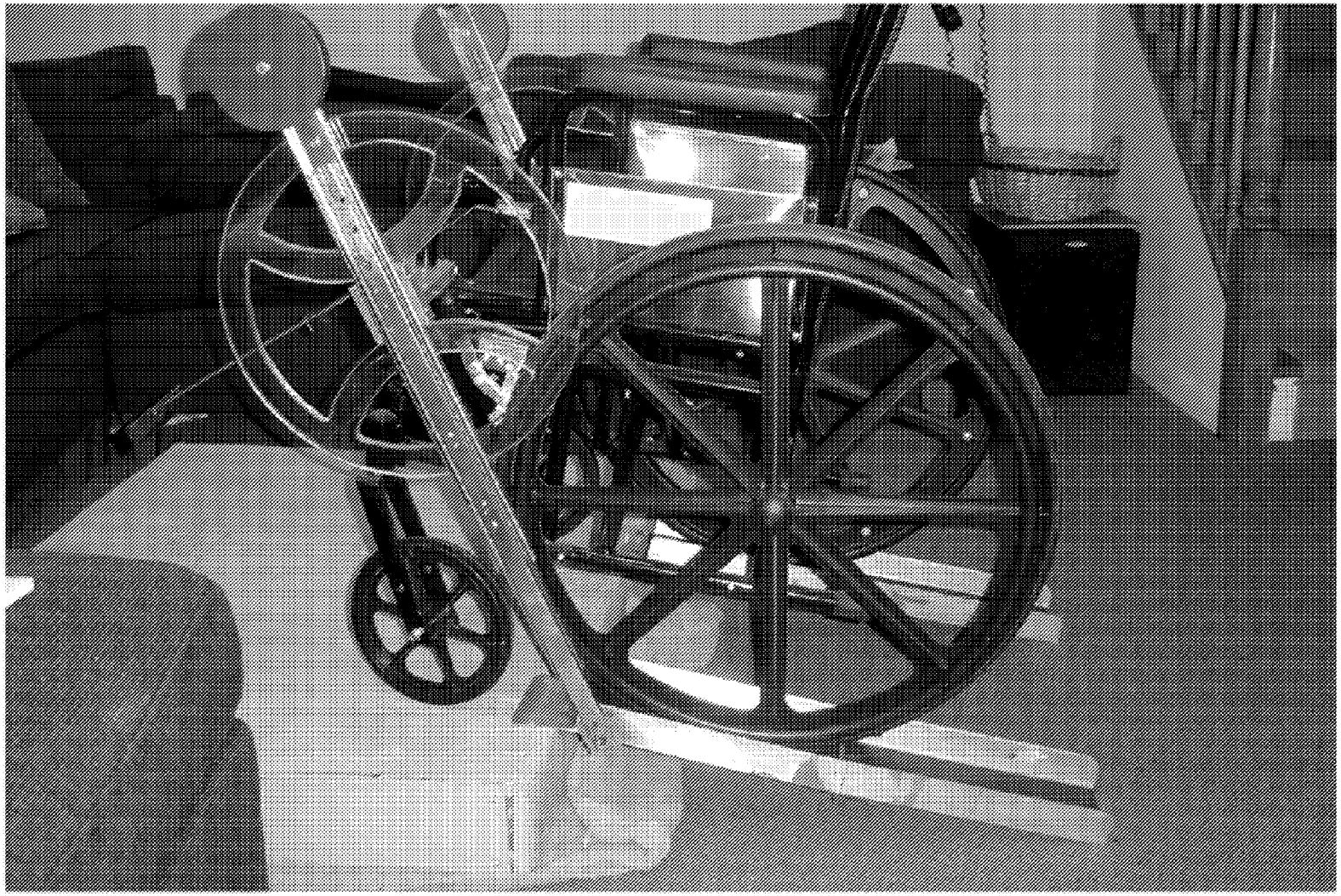
Figure 13D:
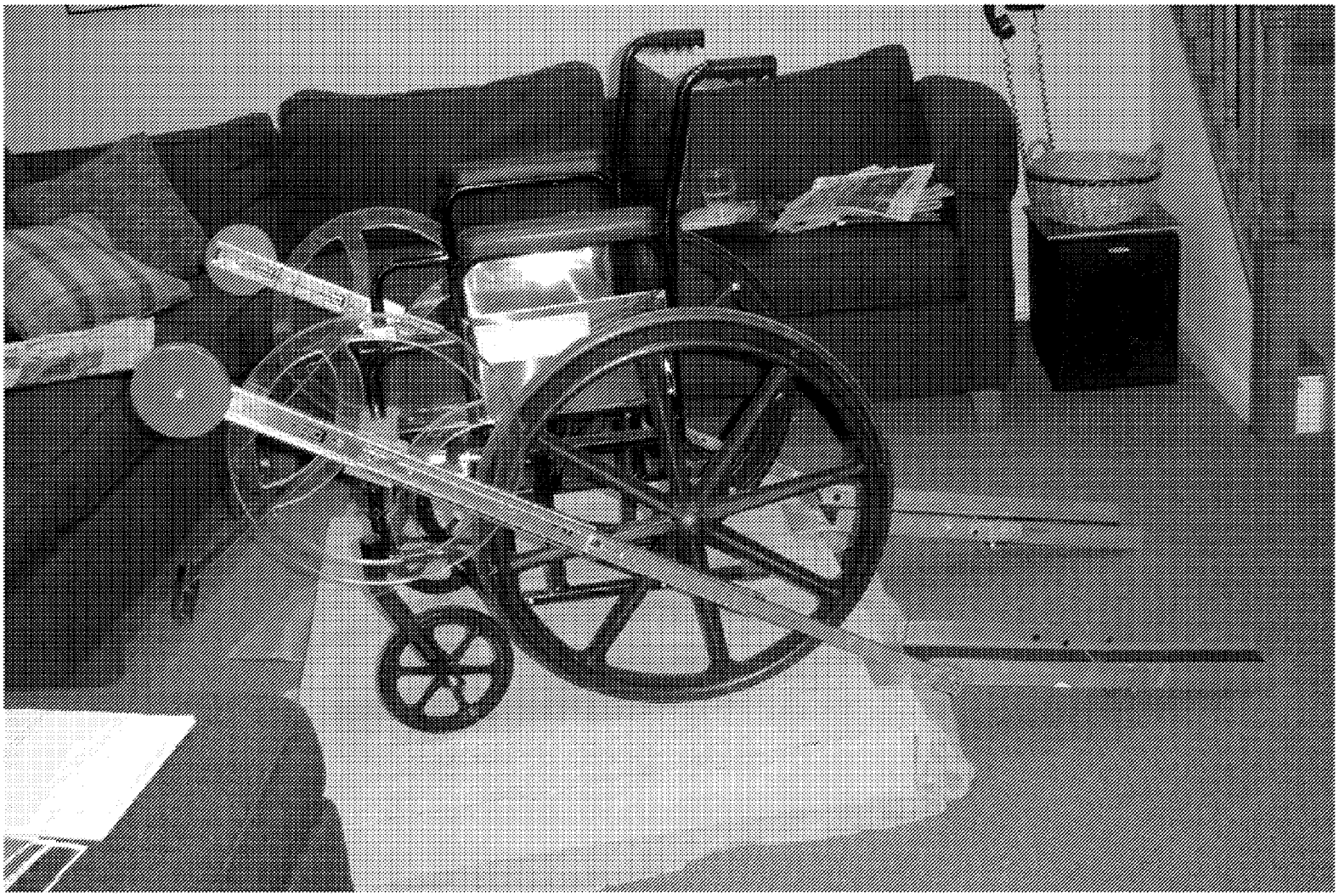

Each ramp is attached to a respective telescoping arm 20, as shown in FIGS. 1, 2A, 2B, 4A and 4B, and various other figures. The telescoping arm 20 freely extends from its shortest length to its longest length using a ball bearing-type design (e.g., a drawer slide). Other suitable types of telescoping arms may be employed. Telescoping arm 20 enables the wheelchair to remain attached to the ramp at all times. For example, FIG. 1 shows the ramp deployed in a position prior to when the wheelchair rolls up the ramp and, in such position, the telescoping arm is at or near its longest length. FIG. 13B (to be discussed) shows when the wheelchair is being rolled up the ramp and, in such position, the telescoping arm has a shorter length. FIGS. 3A and 5 show the ramp prior to deployment and, in such positions, the telescoping arm is at or near its shortest length.

Figure 6:
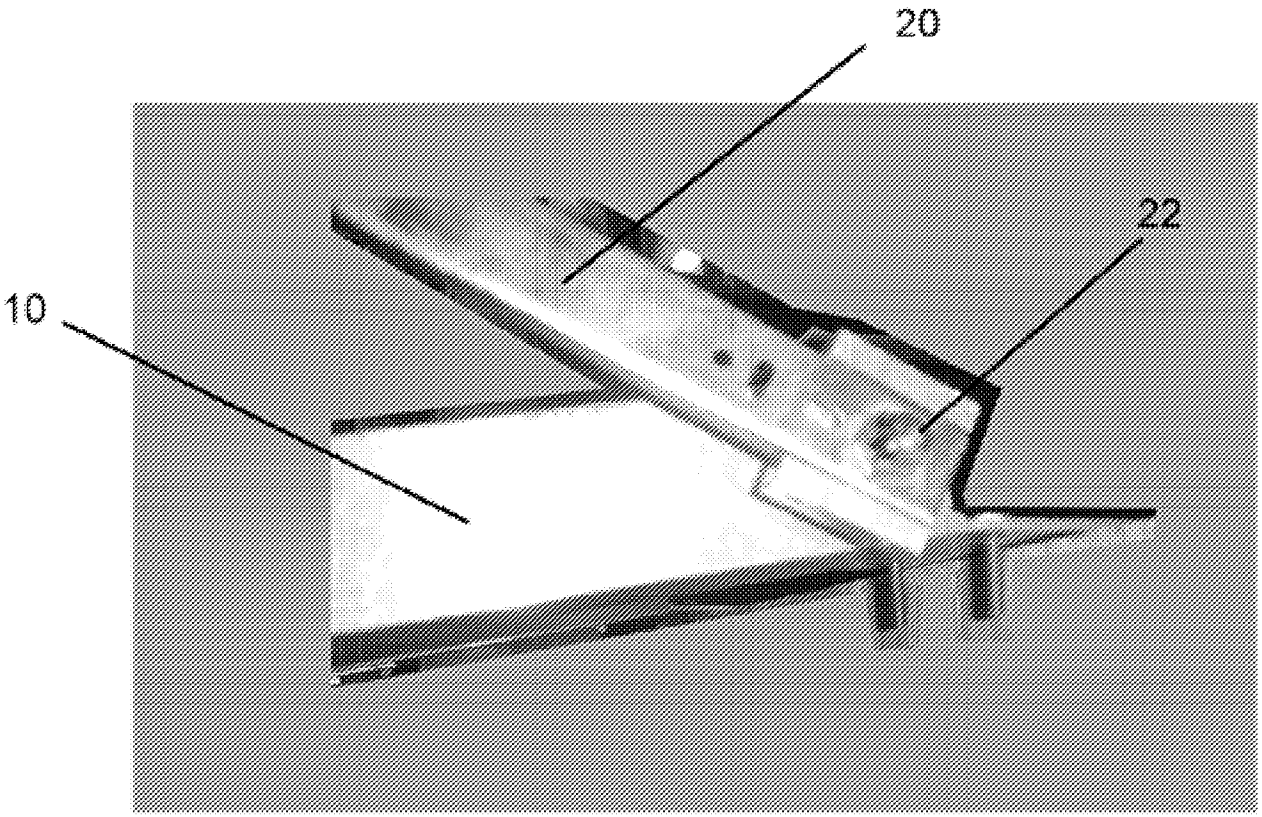
FIG. 6 shows the hinged connection between the telescoping arm and the ramp.

Telescoping arm 20 is coupled to ramp 10 in any suitable manner, such as by the use of a bolt 22 (and associated components), as shown in FIG. 6, that allows the ramp to freely and smoothly rotate relative to the telescoping arm 20 at its point of attachment. FIGS. 1 and 5 illustrate different rotational positions of the ramp and telescoping arm relative each other.

A clamping system 60 (shown in FIGS. 7 and 8A-8C to be discussed) connects telescoping arm 20 to the wheelchair at a pivot point "X" (see FIG. 1) along the telescoping arm in a manner that allows the telescoping arm to freely rotate 360 degrees about pivot point "X" (e.g., see relative positions of telescoping arm 20 in FIGS. 1 and 5). Clamping system 60 is further described in the Clamping System section below.

The Circular Handle

Figure 7:
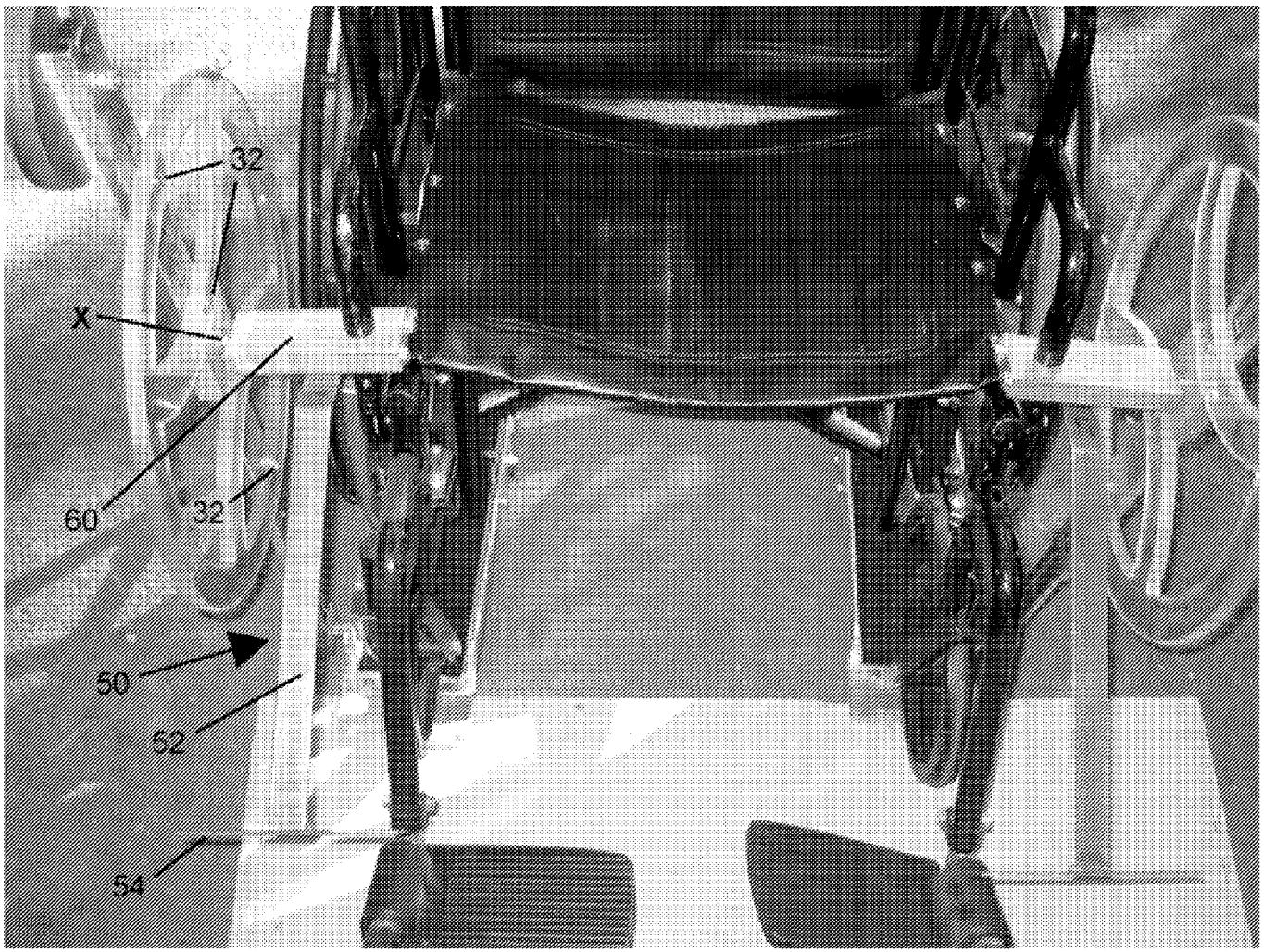
FIG. 7 shows the curb climbing wheelchair attachment, installed on a wheelchair, with particular emphasis on the clamping system and the inverted T-shaped holder.
Figure 8B:
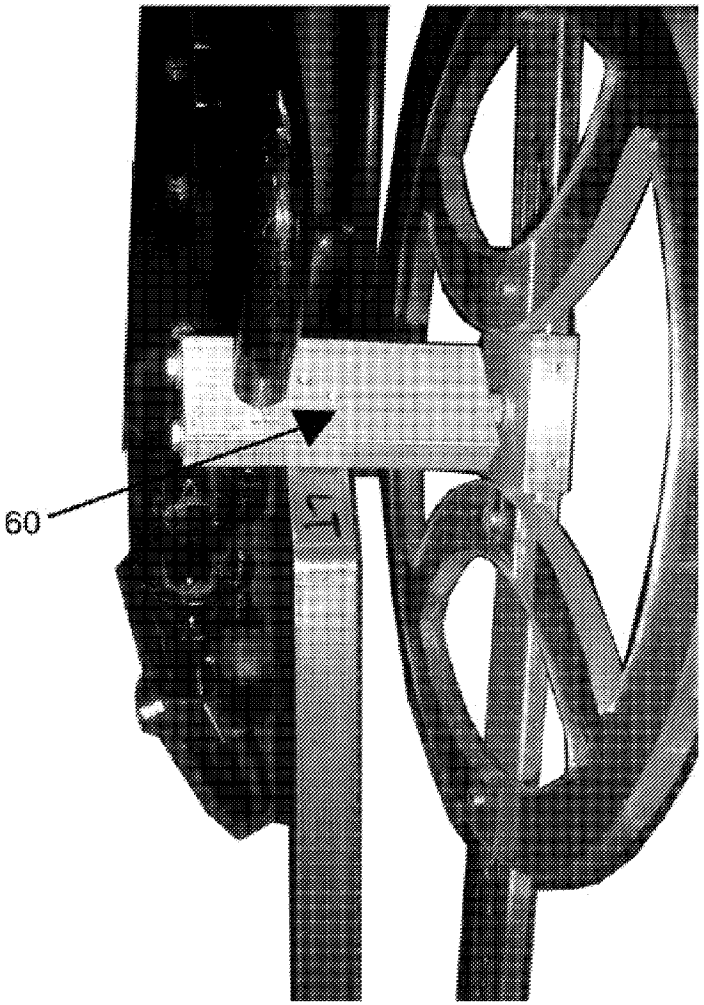
FIGS. 8A-8C show additional views of the clamping system.
Figure 8A:
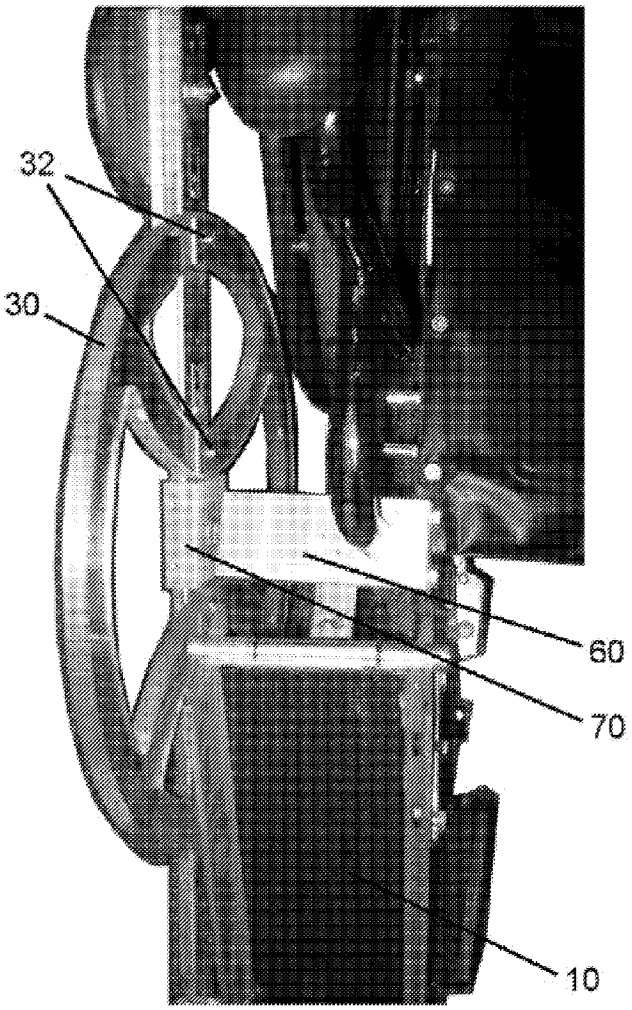
Figure 8C:
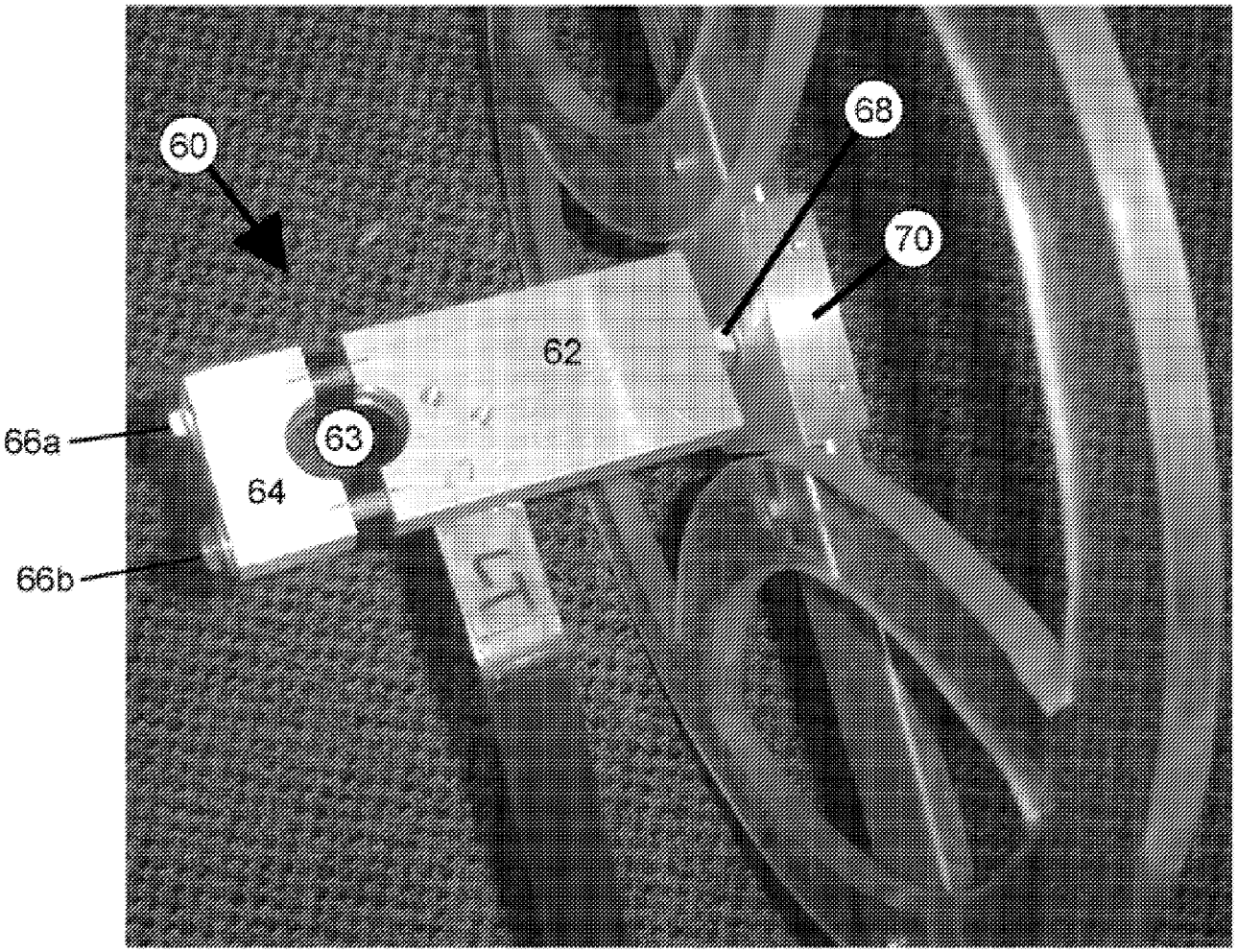
Figure 9:
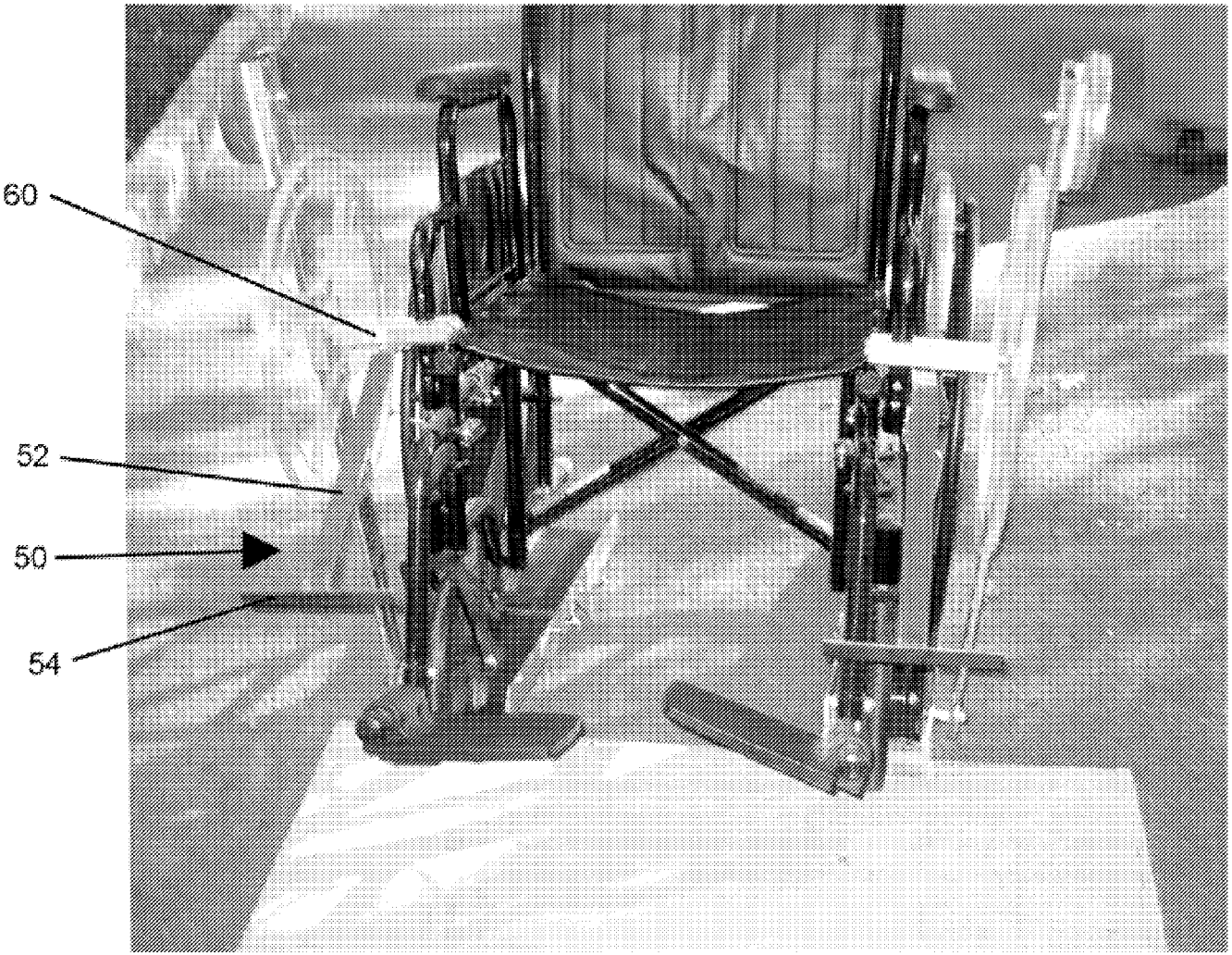
FIG. 9 shows another view of the curb climbing wheelchair attachment, installed on a wheelchair, with particular emphasis on the inverted T-shaped holder.

Each telescoping arm 20 (of the left and right side attachments 1 and 2) also is connected to a respective circular handle 30. As shown in FIGS. 4B, 7 and 8A, a series of bolts 32 secures telescoping arm 20 to circular handle 30. Telescoping arm 20 may be secured to circular handle 30 is any other suitable manner. As shown in FIG. 1, the center-point of circular handle 30 is disposed at pivot point X to allow telescoping arm 20 to be rotated about pivot point X by turning circular handle 30.

Circular handle 30 is made of any suitably strong material, including light-weight metal or plastic. In the various figures, circular handle 30 is made of clear acrylic to minimize viewing obstruction to the wheelchair operator and for aesthetic purposes.

Circular handle 30 preferably includes two inner ellipses 34*a* and 34*b*, as identified in FIG. 2B, which the user can grasp to be able to grip the handle. Circular handle 30 also preferably is smoothly polished and buffed on its inner and outer edges in order to provide a smooth gripping surface for the wheelchair occupant.

As shown in the various figures, circular handle 30 is disposed at a position relative to the wheelchair so that the wheelchair operator's arms are reasonably close to each circular handle to enable the operator to retrieve the ramp after use, as further described below.

Counter-Balance

A counter-balance 40 is secured to the free end of telescoping arm 20, as shown in FIGS. 1, 2A, 2B and various other figures. Counter-balance 40 is sufficiently heavy to minimize the amount of effort by the wheelchair operator to turn circular handle 30 to retrieve the ramp after use (further described below). Generally, the mass of counter-balance 40 depends on the mass of ramp 10 and preferably is slightly lighter than ramp 10 so that ramp 10 naturally remains in the stowed position, to be further discussed.

Clamping System

Clamping system 60 enables the curb climbing wheelchair attachment to be attached to a standard wheelchair. Clamping system 60 is shown in use in FIGS. 8A and 8B and is shown disconnected from the wheelchair in FIG. 8C. As particularly shown in FIG. 8C, clamping system 60 includes a main support section 62 and a clamping section 64 that is secured to the main support section 62 via two bolts 66*a* and 66*b*. Each section 62 and 64 includes a respective semi-circular cutout such that when sections 62 and 64 are secured together, a round hole 63 of sufficient size is formed that corresponds to the size of the tubing of a standard wheelchair. To install the curb climbing wheelchair attachment to a wheelchair, main support section 62 and clamping section 64 are placed around the wheelchair's tubing (FIGS. 8A and 8B), and then bolted together with bolts 66*a* and 66*b*.

Suitable adapters may be provided, as needed, to accommodate wheelchair tubing of different sizes. Moreover, while a particular design of clamping system 60 is described and shown, other suitable clamping designs that sufficiently attach the curb climbing wheelchair attachment to a wheelchair may be employed. Thus, for purposes herein, the phrase "clamping system" shall include other securing techniques and designs.

Clamping system 60, via its main support section 62, also is coupled to telescoping arm 20 by a suitable bolting mechanism 68 (FIG. 8C) in a manner that allows telescoping arm 20 and circular handle 30 to freely rotate around bolting mechanism 68 whose position corresponds to the above-mentioned pivot point X. If needed, an additional bracket 70 (FIG. 8C) may be employed, which is fixed to telescoping arm 20 and through which the bolting mechanism 68 extends. Any other suitable device or manner of connection may be employed that allows telescoping arm 20 to be supported by, but freely rotatable relative to, clamping system 60.

Clamping system 60 is made of a material (e.g., aluminum, steel) that is sufficiently strong to support each of the elements of the curb climbing wheelchair attachment.

Inverted T-Shaped Holder

Figure 10:
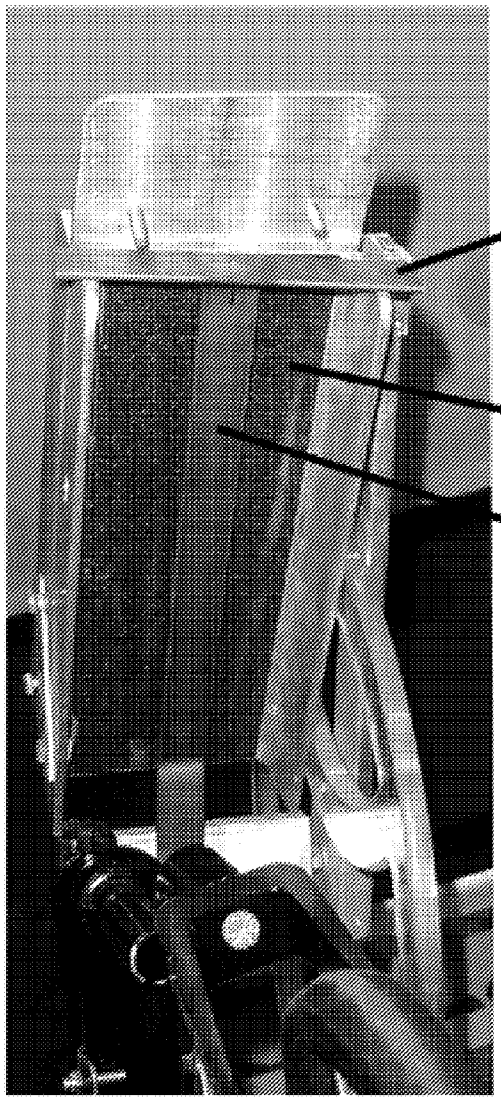
FIG. 10 shows a bottom view of the ramp when in the stowed position.

An inverted T-shaped holder 50, as shown in FIGS. 3F, 4A, 7 and 9, extends from clamping system 60 for storing the ramp during non-use, as further discussed in the Operation section below. Inverted T-shaped holder 50 includes a narrow arm 52 that is fixed to (e.g., via screws or bolts) clamping system 60. Narrow arm 52 extends forward of and downward from clamping system 60. Narrow arm 52 is sufficiently long so that it completely supports ramp 10 (in its folded position) when stowed (to be discussed), as best shown in FIG. 10, which shows a bottom view of elements 52 and 54 of inverted T-shaped holder 50 while supporting ramp 10 in its folded position. Inverted T-shaped holder 50 also includes a relatively small, wide section 54 that extends upwardly from the lower end of narrow arm 52. Wide section 54 is sufficiently wide so as to maintain ramp 10 on narrow arm 52 when stowed.

Operation

Figure 11:
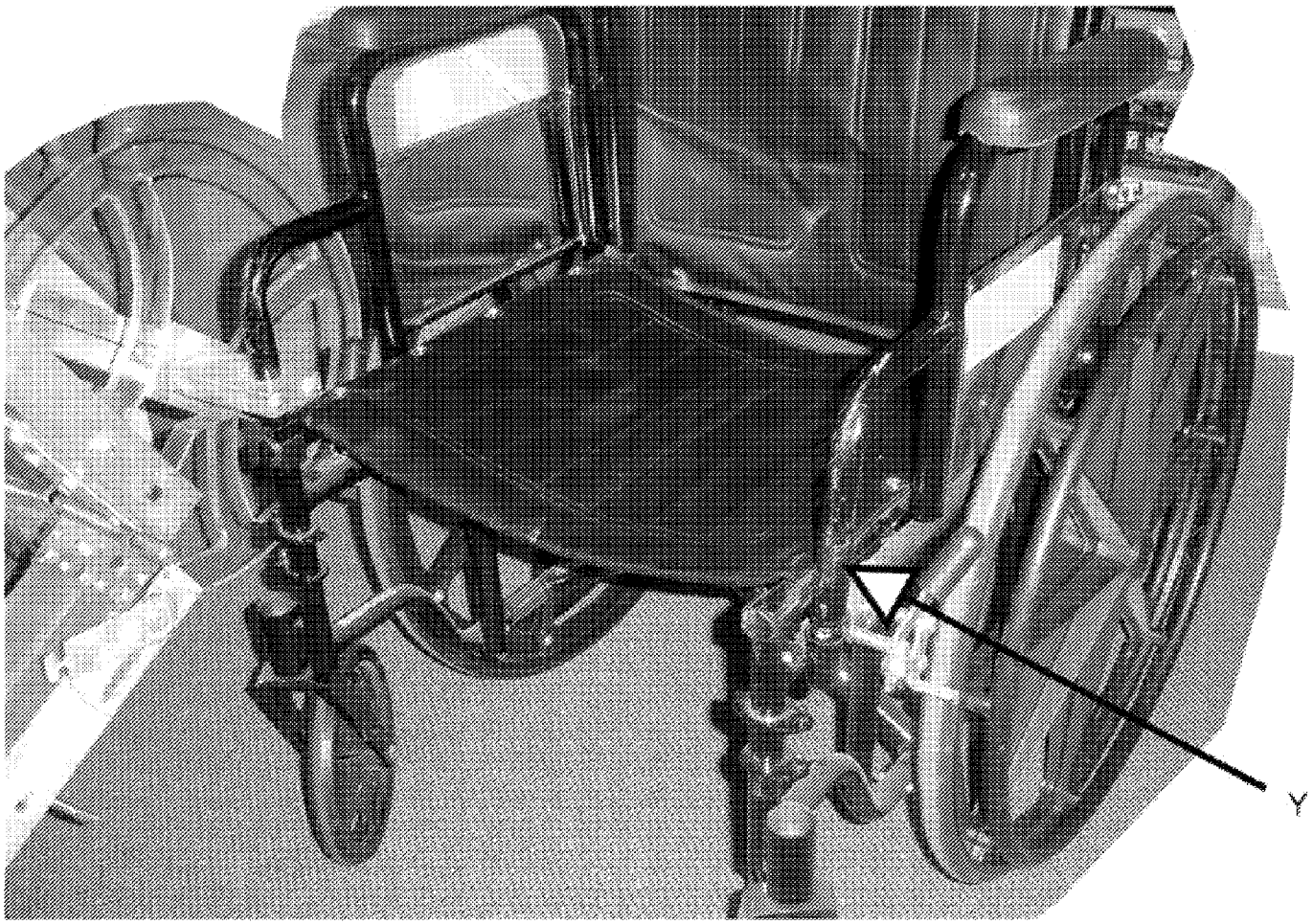
FIG. 11 illustrates the location on a standard wheelchair where the curb climbing wheelchair attachment may be attached.

The curb climbing wheelchair attachment is attached to a standard wheelchair via clamping system 60 in the manner described above (see Clamping section above). FIG. 11 illustrates the location "Y" on a standard wheelchair where the curb climbing wheelchair attachment is attached.

The ramp initially is placed in its stowed position and remains in the stowed position while the ramp is not used. To stow the ramp, ramp segment 10*b* is placed on, in its upside-down position (i.e., ramp surface facing down), inverted T-shaped holder 50, as shown in FIG. 3C. More specifically, ramp segment 10*b* is placed on narrow arm 52 (see FIG. 10) and, in such position, narrow section 54 of the inverted T-shaped holder 50 prevents ramp segment 10*b* from sliding down and off holder 50. Also, in this position, the ramp's left and right side walls 10*d* and 10*e* (see FIG. 10) are disposed on and extend beneath the opposite sides of narrow arm 52 thus preventing the ramp from moving too much to the left or to the right (e.g., during the wheelchair's use) to cause the ramp to slip off the inverted T-shaped holder.

Ramp segment 10*a* is brought down until the ramp is completely folded, as shown in FIG. 3A. The folded ramp is locked via latch 18, as previously discussed (FIGS. 3A and 3B). Ramp 10, now in its stowed position, is completely folded in half, whereupon the ramp is stored at a position along the lower side of the wheelchair where it minimally impedes the wheelchair operator's view.

Figure 12A:
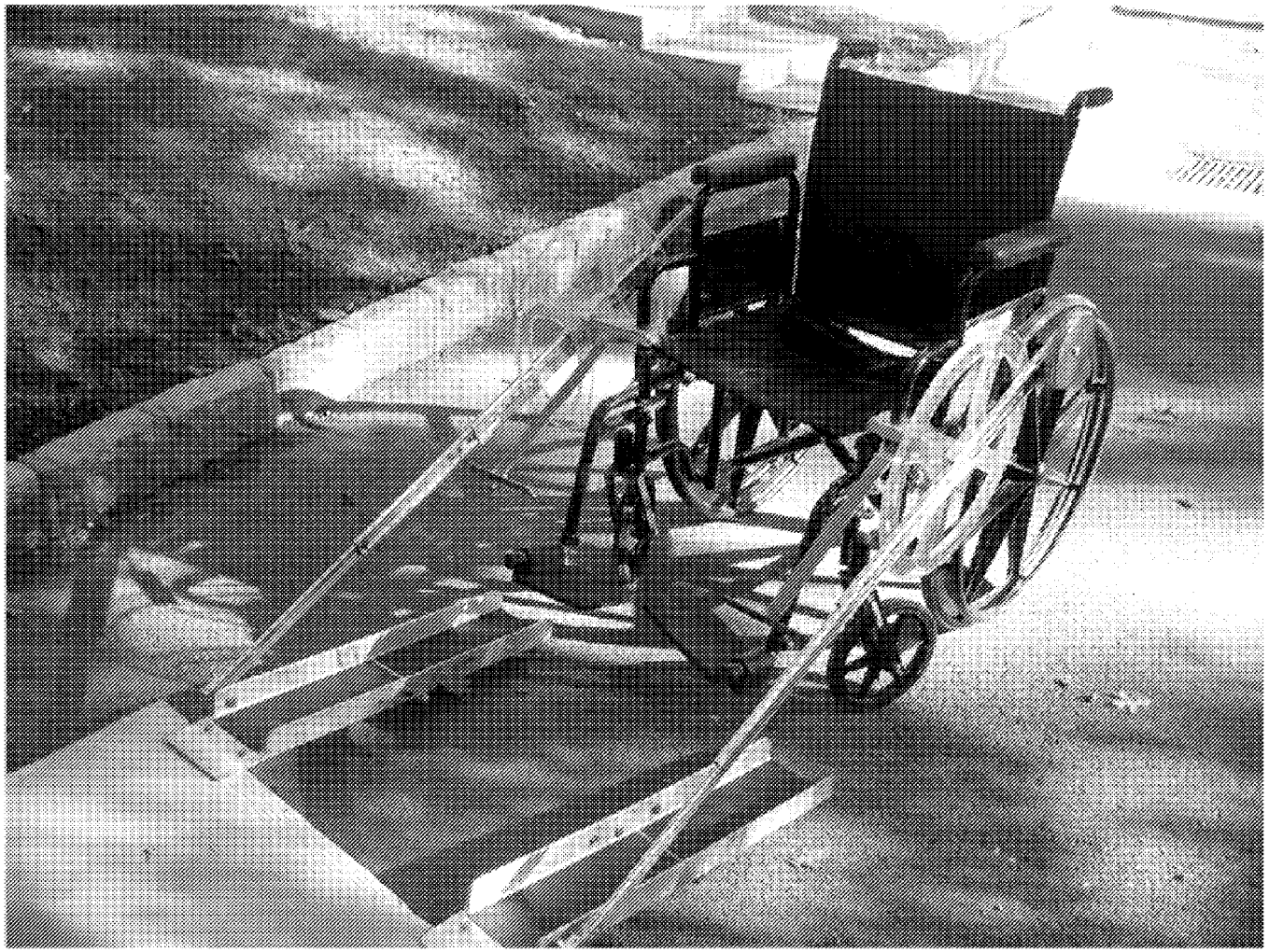
FIGS. 12A and 12B show a couple of views of the curb climbing wheelchair attachment with the ramps in the deployed position.
Figure 12B:
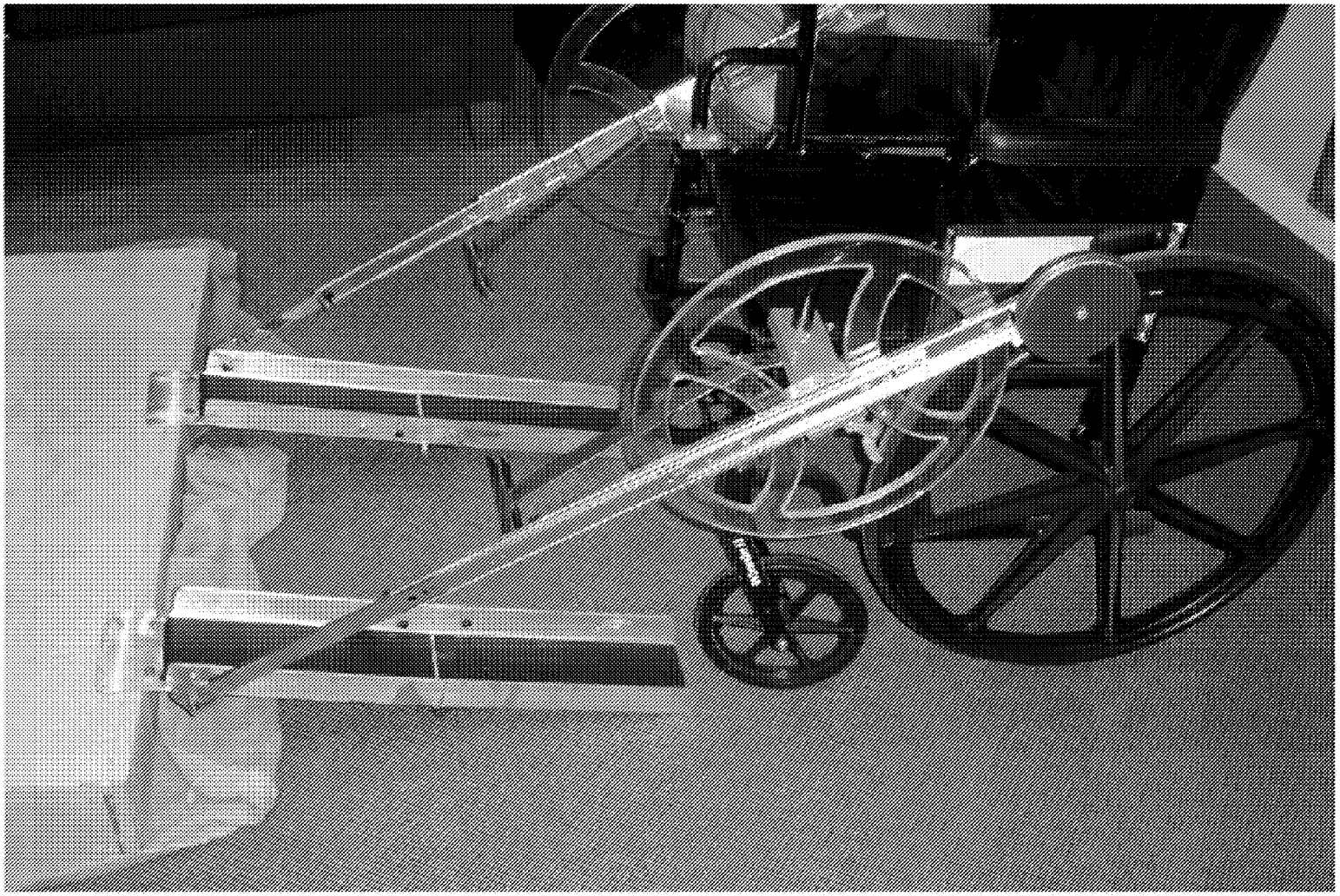

While the ramp (i.e., both the left and right ramps) is stowed, the wheelchair is completely usable in its normal manner. When it is desired to use the ramp to ascend a curb or a bump or other obstruction (for convenience, all referred to as a "curb"), latch 18 is unlocked and the ramp is moved from its folded position (FIG. 3A) to a partially unfolded position (FIG. 3C) and then finally to its fully extended position (FIG. 3D). In the fully extended position, latch 18 is locked so that the ramp stays in its fully extended position. The now-fully extended ramp is lifted (if still partially resting on holder 50) and lowered down (e.g., by the user bending forward) until the ramp is resting on the ground. Depending on the abilities of the wheelchair operator, the ramp may be placed directly on the ground with the ramp's lip 14 resting directly on the curb (see, e.g., FIGS. 12A and 12B). As described above, pins 16 that extend beneath lip 14 preferably abut the curb for additional stability (see FIG. 1). If the ramp is not properly positioned, the user may utilize circular handle 30 to assist in the lowering and/or lifting of the ramp.

When the ramp is properly positioned as described above, and after the wheels of the wheelchair are properly aligned with the ramp, both the wheelchair and the ramp are now in proper position to enable the wheelchair to ascend the ramp. The wheelchair is moved up the ramp (under the manual power of the wheelchair operator or by a third person pushing the wheelchair). FIGS. 13A, 13B, 13C and 13D show the progression of the wheelchair moving up the ramp.

Figure 14A:
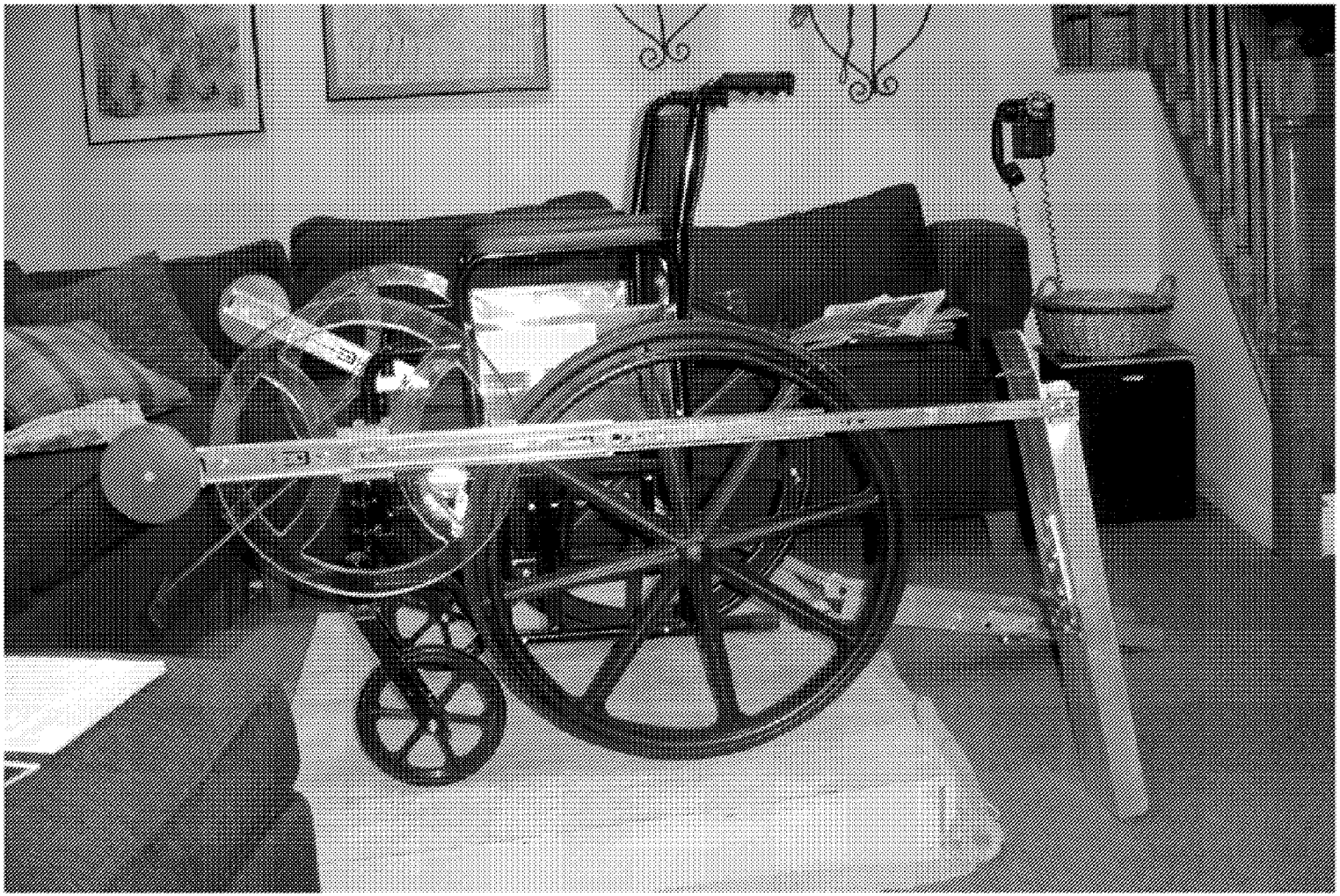
FIGS. 14A-14D show various views during different points of operation of the present invention to retrieve and stow the ramps after the wheelchair has rolled up the ramps.
Figure 14B:
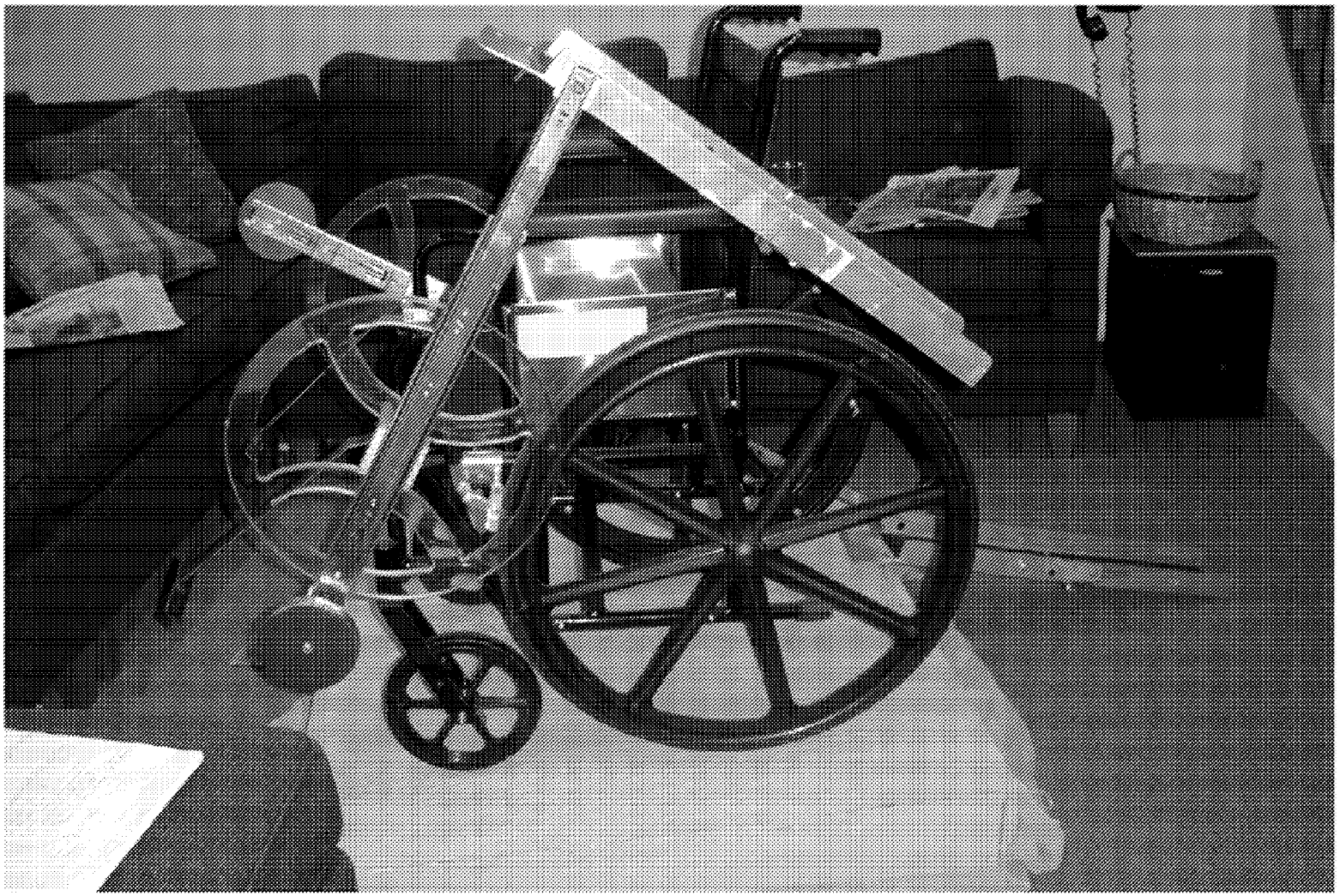

After ascending the curb, and all of the wheels of the wheelchair are completely off the ramp, the ramp must be lifted off the ground for final stowing. The wheelchair operator (or other person) lifts telescoping arm 20 in order to lift the ramp that now is positioned behind the wheelchair. The weight of counter-balance 40 aids in the lifting of the ramp in this position. Beneficially, the user may utilize, that is, turn circular handle 30 to assist in the lifting of the ramp. In particular, the user may lift the ramp by turning circular handle 30, which minimizes the user's need to turn around while retrieving the ramp. In any event, the ramp initially is lifted off the ground as shown in FIG. 14A and then the ramp is brought forward as shown in FIG. 14B.

Figure 14C:
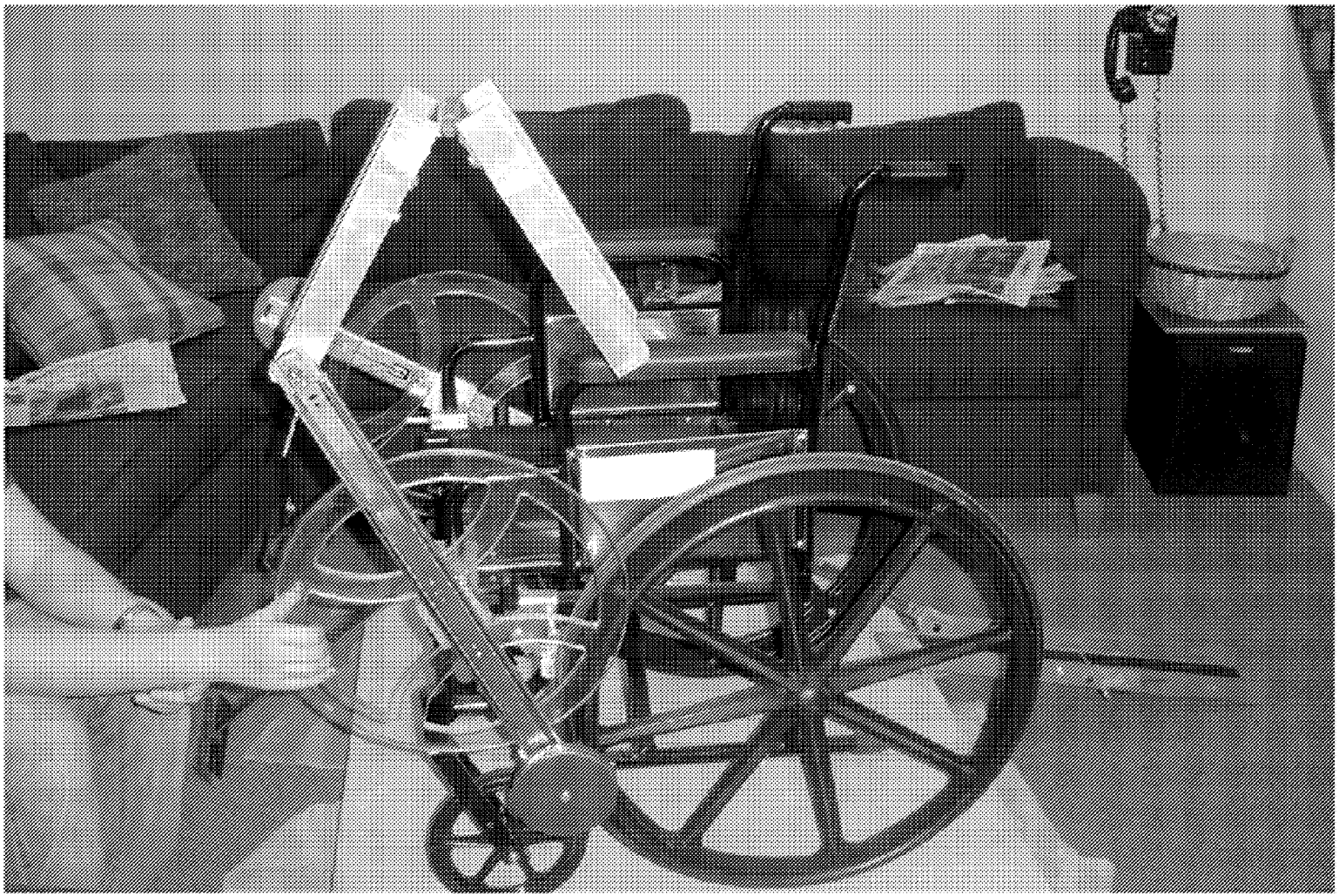
Figure 14D:
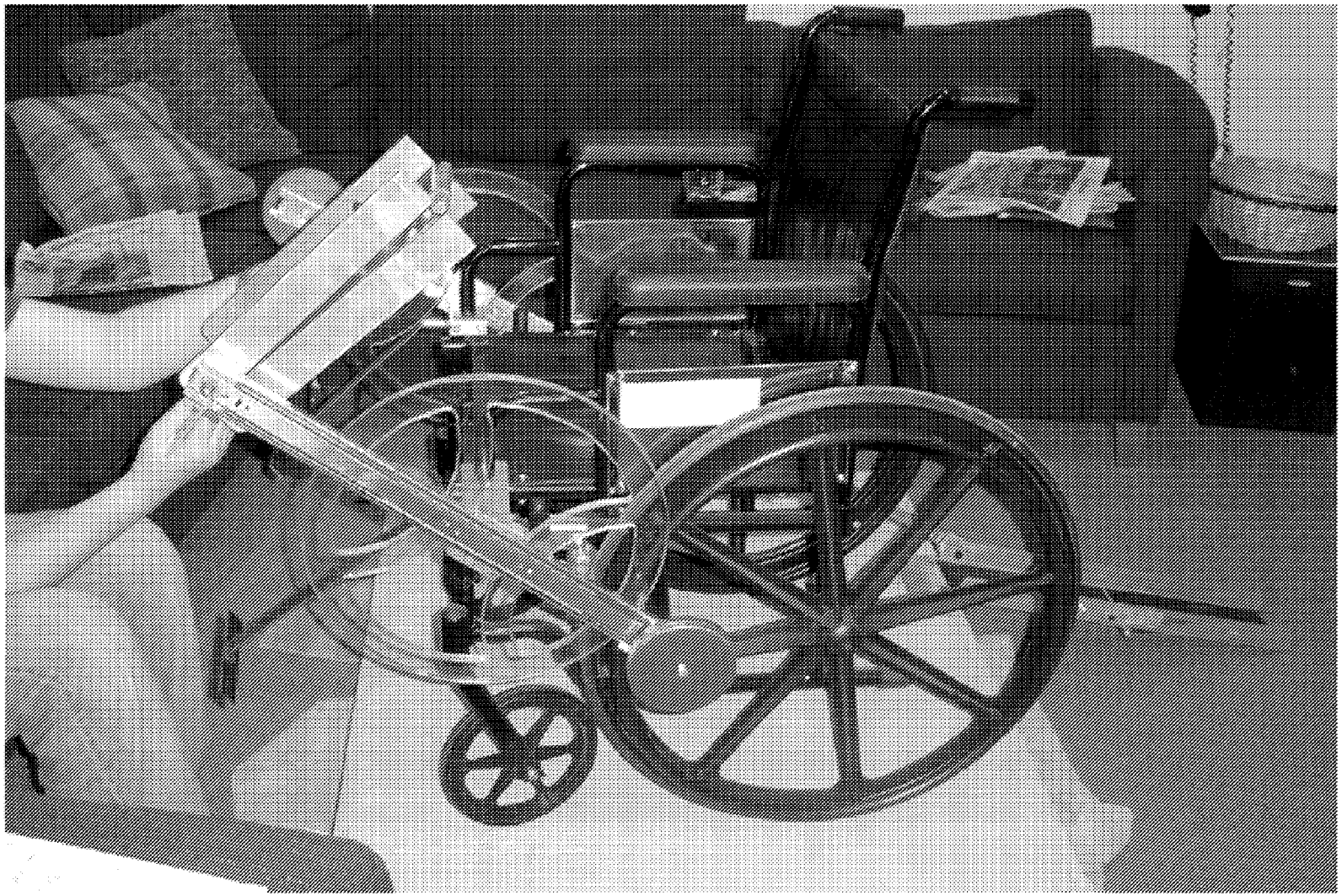

As the ramp is brought forward, by lifting telescoping arm 20 with or without the use of circular handle 30, the user takes hold of ramp 10, unlocks latch 18, folds the ramp in half, and then relocks latch 18. FIGS. 14C and 14D show the relative positions of the ramp and telescoping arm as the ramp is folded in half. Finally, the ramp is placed on inverted T-shaped holder 50 for final storage, as shown in FIG. 3A. The wheelchair now is ready for its continued, normal use.

Storage and Transportation

Figure 15:
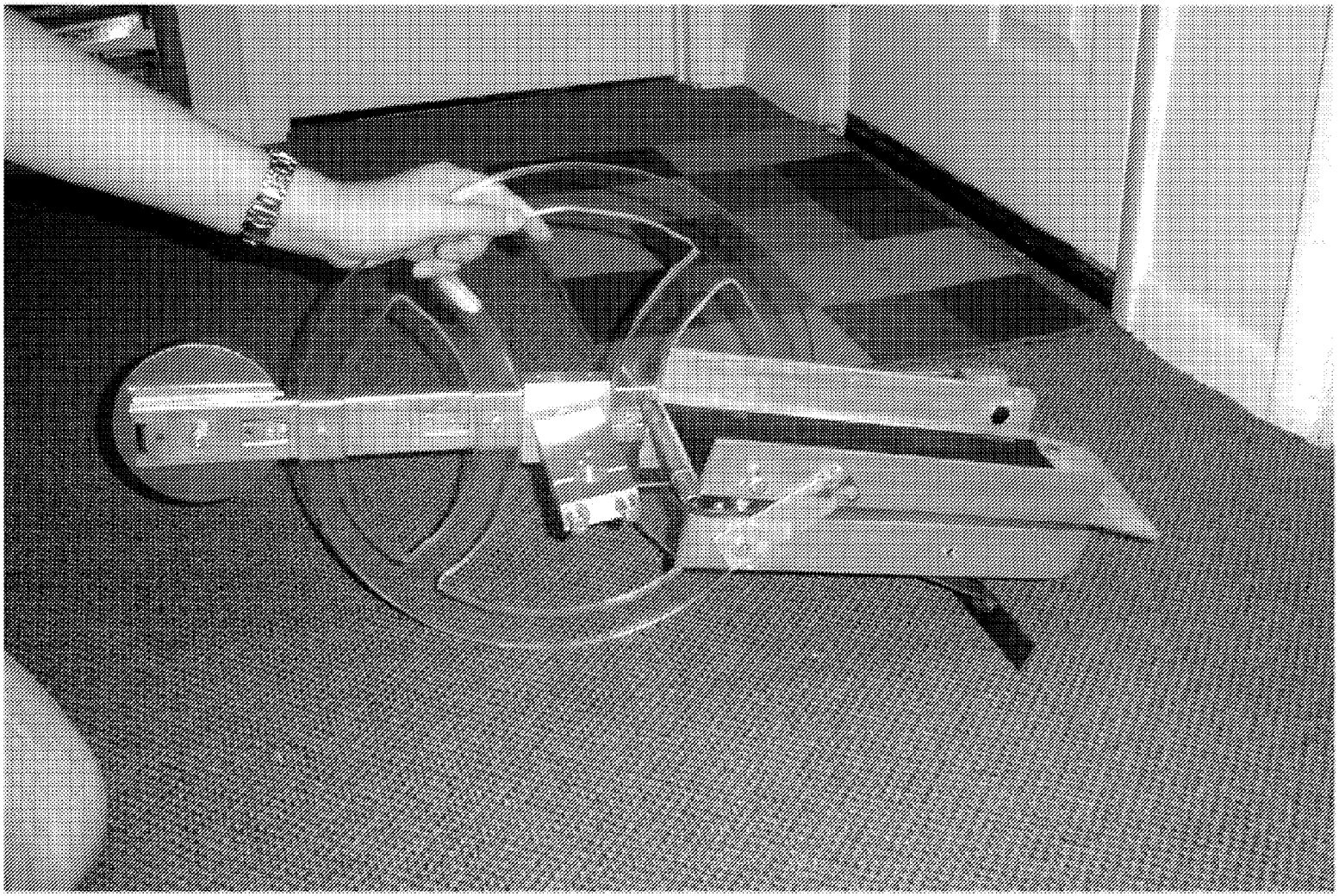
FIG. 15 shows the curb climbing wheelchair attachment with its ramp folded in half.

When not connected to a wheelchair, the curb climbing wheelchair attachment (i.e., both its left and right side attachments) is relatively small and thus can be easily placed in the trunk of a vehicle or other location for easy and convenient storage and transportation. FIG. 15 shows the curb climbing wheelchair attachment with its ramp folded in half, and its relative size in relation to a person's hand and arm.

Figure 16A:
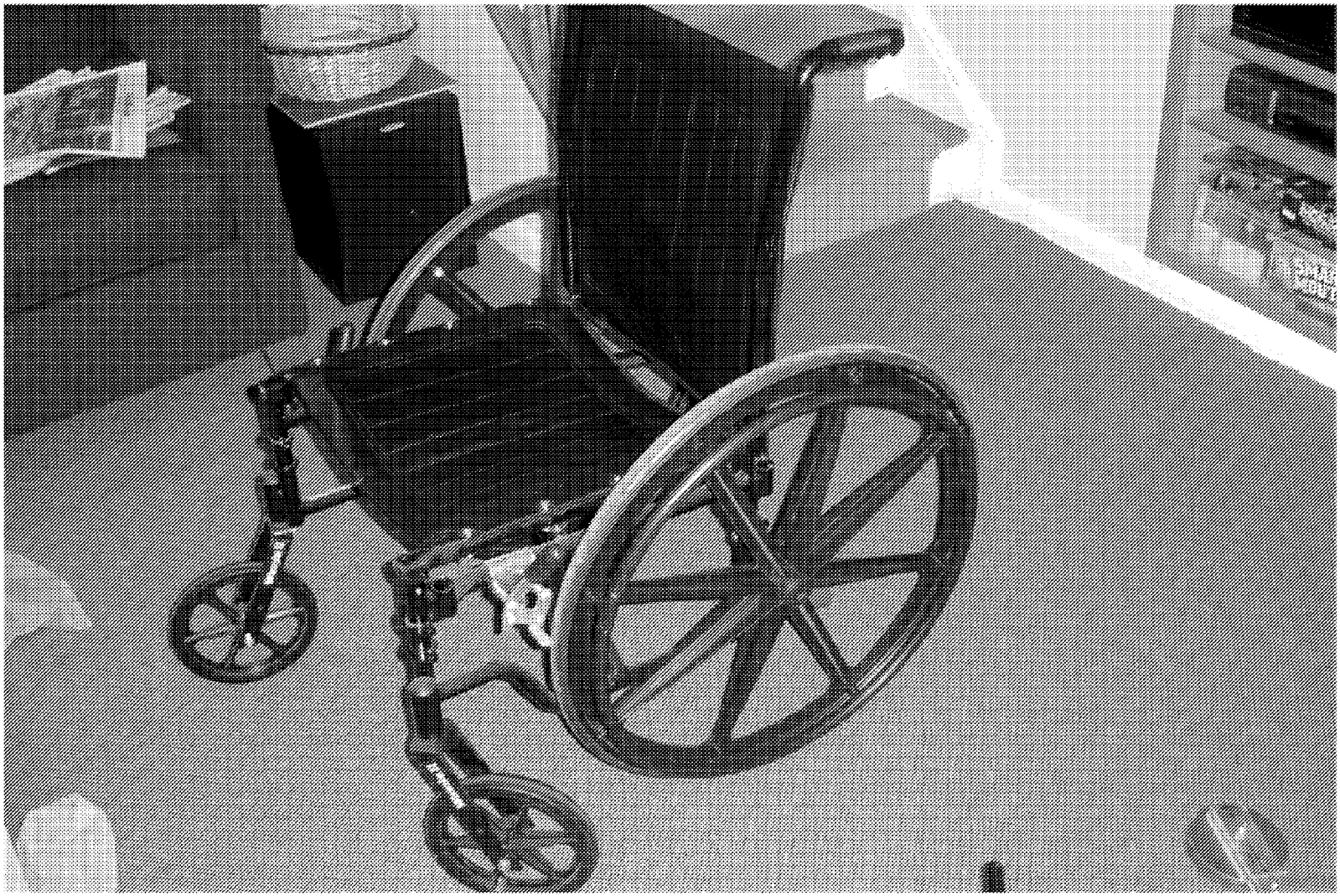
FIG. 16A shows a wheelchair with its arm support removed.
Figure 16B:
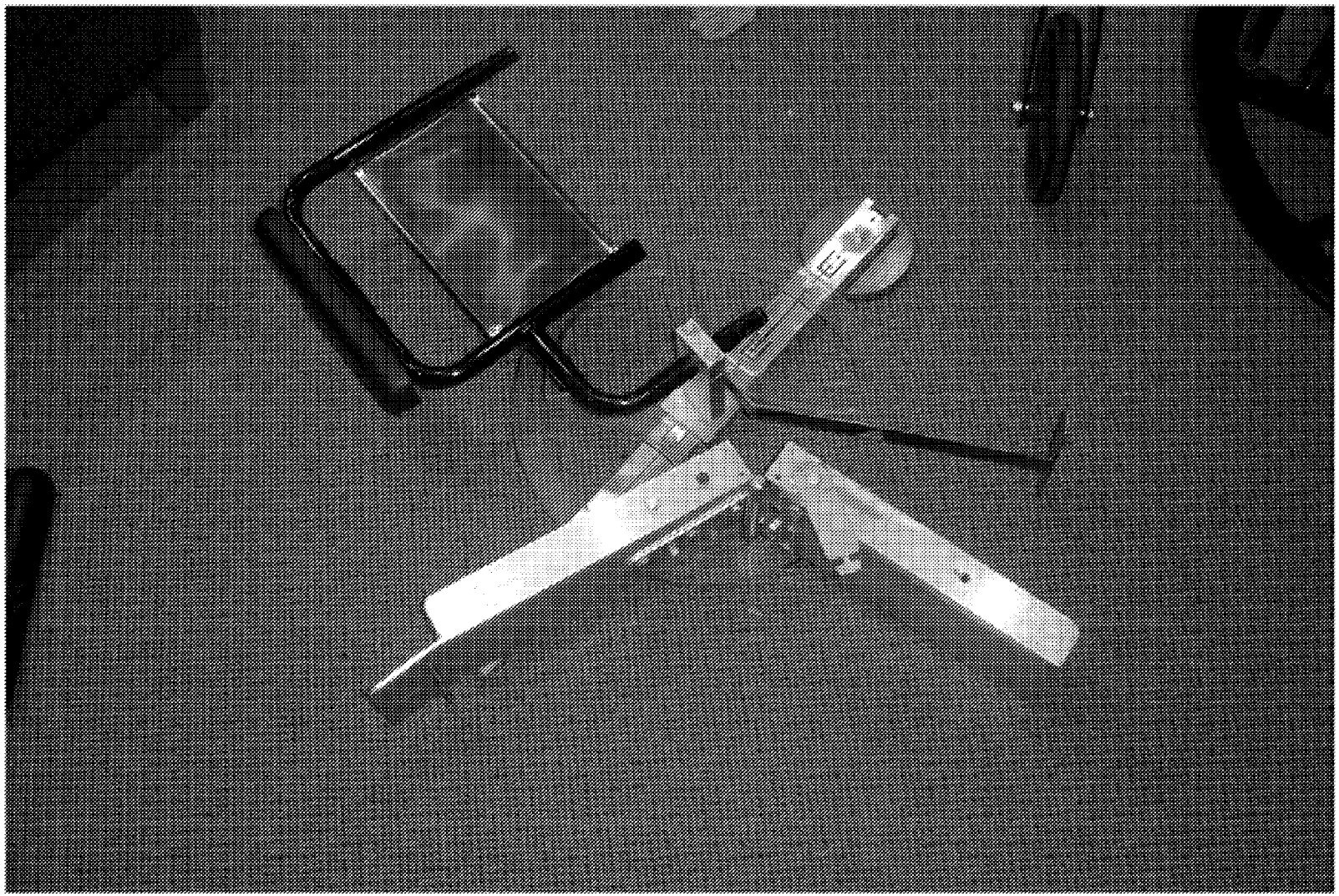
FIG. 16B shows the curb climbing wheelchair attachment attached to a removed wheelchair arm support.

In addition, the curb climbing wheelchair attachment's clamping system is designed to be attached to different types of wheelchairs with standard armrests or with standard types of tubing. Some standard wheelchairs have armrests that are detachable. For example, FIG. 16A shows a wheelchair with its arm support removed. For these types of wheelchairs, the curb climbing wheelchair attachment may be easily removed while still remaining attached to the arm support. FIG. 16B shows one such removed arm support to which the curb climbing wheelchair attachment remains attached. Thus, transportation of a wheelchair may be facilitated, if desired, by removing the arm supports along with the attached curb climbing wheelchair attachment.

Testing and Expanded Options

The curb climbing wheelchair attachment has been tested on both a wooden curb that we built as well as an actual curb. Additionally, roadside curbs have varying heights. Therefore, the user of the curb climbing wheelchair attachment will need to deploy the ramp and use his/her judgment to best place the ramp according to the height and the structure of the given curb.

To assist the wheelchair operator during use of the curb climbing wheelchair attachment, the curb climbing wheelchair attachment as described above and shown in the figures may be modified in various manners. In one variation, the telescoping arm is equipped with a powered (e.g., battery powered) actuator for controlling the length of the arm during deployment of the ramp and also during retrieval of the ramp after its use. A powered circular handle also may be employed to aid the wheelchair operator during use of the curb climbing wheelchair attachment. More intricate variations include a combination of a powered telescoping arm and a powered circular handle to minimize the physical effort needed to deploy and retract the ramp. Unfortunately, the addition of powered elements will increase the cost of the invention but depending on the needs of the wheelchair operator, the added cost may be justified.

Although the curb climbing wheelchair attachment is intended to be a relatively low-cost device that may be purchased/obtained separately for attachment to already obtained wheelchairs, it is possible for its components to be pre-installed and/or permanently attached to a wheelchair.

Our invention addresses the problem of a handicapped person's struggle to get over curbs without curb cutouts in an independent manner. By utilizing our invention, people in wheelchairs will be able to effectively go over a curb without having to find an assistant or go completely out of their way to find curb cut-outs. This invention is very practical, and is not much of a burden for a handicapped person to carry around once it has been attached to their wheelchair.

CONCLUSION

The curb climbing wheelchair attachment, as described in this document and shown in the figures, allows a wheelchair occupant to climb a sidewalk curb without substantially expensive and complex equipment. In communities that neglect to cut out their curbs, wheelchair occupants can exercise their right to travel where they please. No longer will they have to depend on others to do something as simple as getting onto a sidewalk. Something that seems so effortless to most people is a burden to others. The purpose of this invention is to reduce this burden, allowing wheelchair occupants to be more independent, and to rise up unaided above street level.

Given the above description of the curb climbing wheelchair attachment of the present invention, it is intended that the appended claims be interpreted as including the embodiments described herein, the alternatives mentioned above, and all equivalents thereto.

What is claimed is:

1. A curb climbing wheelchair attachment, comprising:

left and right side attachments adapted for respective attachment to left and right side portions of a wheelchair, each of the left and right side attachments comprising:

a telescoping arm having first and second ends and adapted to extend between an extended length and a shortened length;

a ramp rotatably coupled to the first end of the telescoping arm;

a handle fixed to the telescoping arm and adapted to be grabbed by an occupant of the wheelchair to control an orientation of the telescoping arm;

a ramp holder coupled to the telescoping arm and adapted to maintain the ramp in a stowed position when not in use; and a clamping mechanism rotatably coupled to the telescoping arm for enabling attachment of the respective side attachment to the respective side portion of the wheelchair;

the ramps of the left and right side attachments collectively adapted, when in a deployed position, to allow the occupant of the wheelchair to move the wheelchair across the ramps.

2. The curb climbing wheelchair attachment of claim 1, wherein, for each of the left and right side attachments, the ramp is adapted to be movable from the stowed position to a deployed position abutting against a curb, wherein in the deployed position a front end of the ramp is positioned on the curb and a rear end of the ramp is positioned on a surface disposed adjacent to and beneath the curb, the telescoping arm being extended to substantially the extended length when the ramp is in the deployed position, and the telescoping arm being adapted to have a length that decreases, approaching substantially the shortened length, as the wheelchair is rolled onto the ramp.

3. The curb climbing wheelchair attachment of claim 2, wherein, for each of the left and right side attachments, the telescoping arm is adapted to increase in length, approaching substantially the extended length, as the wheelchair is rolled from a position on the ramp to a position beyond the ramp.

4. The curb climbing wheelchair attachment of claim 3, wherein, when the wheelchair is at the position beyond the ramp, the orientation of the telescoping arm is adapted to be modified by the occupant of the wheelchair to cause the first end of the telescoping arm to be raised to enable the occupant to grab the ramp and to place the ramp in the stowed position within the ramp holder.

5. The curb climbing wheelchair attachment of claim 1, wherein the ramp of each of the left and right side attachments includes first and second ramp segments hinged together and movable between a folded position and an extended position.

6. The curb climbing wheelchair attachment of claim 5, wherein the ramp of each of the left and right side attachments further includes a latch adapted to selectively lock the first and second ramp segments in the folded position, and to selectively lock the first and second ramp segments in the extended position.

7. The curb climbing wheelchair attachment of claim 1, wherein the ramp of each of the left and right side attachments includes at least one pin extending substantially downward when the respective ramp is in the deployed position and adapted to abut a curb to support a position of the ramp relative to the curb when in the deployed position.

8. The curb climbing wheelchair attachment of claim 1, wherein the ramp of each of the left and right side attachments includes an angled lip so that, when the ramp is in the deployed position, the angled lip lays substantially flat on the curb and a lower end of the ramp is positioned on a surface disposed beneath the curb.

9. The curb climbing wheelchair attachment of claim 1, wherein the handle is a circular handle rotatable about a pivot point, the circular handle being fixed to the telescoping arm, and the pivot point being disposed at a position along the telescoping arm at which the clamping mechanism is rotatably coupled to the telescoping arm so that rotation of the handle causes a change in the orientation of the telescoping arm.

10. The curb climbing wheelchair attachment of claim 1, wherein each of the left and right side attachments further comprises a counter-balance coupled to the second end of the respective telescoping arm.

11. The curb climbing wheelchair attachment of claim 1, wherein the ramp holder of each of the left and right side attachments is an inverted T-shaped device adapted to maintain the respective ramp in the stowed position when not in use.

12. The curb climbing wheelchair attachment of claim 1, wherein the clamping mechanism of each of the left and right side attachments is a clamp adapted to be attached to tubing of the wheelchair.

13. A combination, comprising a wheelchair and the curb climbing wheelchair attachment of claim 1 coupled to the wheelchair.

14. The curb climbing wheelchair attachment of claim 1, wherein the telescoping arm of each of the left and right side attachments freely extends between a shortest length of the telescoping arm and a longest length of the telescoping arm.

* * * * *